US006100868A

United States Patent [19]

Jeong et al.

[11] Patent Number: 6,100,868

[45] Date of Patent: Aug. 8, 2000

[54] HIGH DENSITY COLUMN DRIVERS FOR AN ACTIVE MATRIX DISPLAY

[75] Inventors: Deog-Kyoon Jeong, Sungnam, Rep. of Korea; David D. Lee, Palo Alto, Calif.

[73] Assignee: Silicon Image, Inc., Sunnyvale, Calif.

[21] Appl. No.: 08/937,262

[22] Filed: Sep. 15, 1997

[51] Int. Cl.[7] ..... G09G 3/36

[52] U.S. Cl. ..... 345/98; 345/100; 341/144

[58] Field of Search ..... 345/98, 100, 205, 345/206, 198, 204; 341/144

[56] References Cited

U.S. PATENT DOCUMENTS

| | | | |
|---|---|---|---|
| 3,699,464 | 10/1972 | Zobel | 330/12 |
| 4,511,881 | 4/1985 | Adam | 340/347 |
| 4,748,444 | 5/1988 | Arai | 340/784 |
| 4,772,100 | 9/1988 | Suenaga | 350/336 |
| 4,838,654 | 6/1989 | Hamaguchi et al. | 350/333 |
| 4,868,459 | 9/1989 | Dennerlein et al. | 315/158 |
| 5,051,739 | 9/1991 | Hayashida et al. | 340/784 |
| 5,061,920 | 10/1991 | Nelson | 340/784 |
| 5,214,608 | 5/1993 | Hsu et al. | 365/230.02 |
| 5,243,333 | 9/1993 | Shiba et al. | 345/100 |
| 5,250,931 | 10/1993 | Misawa et al. | 345/206 |
| 5,426,447 | 6/1995 | Lee | 345/103 |
| 5,436,745 | 7/1995 | Voisin et al. | 359/88 |
| 5,455,534 | 10/1995 | Motegi et al. | 327/544 |
| 5,510,807 | 4/1996 | Lee et al. | 345/103 |
| 5,526,014 | 6/1996 | Shiba et al. | 345/96 |
| 5,546,102 | 8/1996 | Scheffer et al. | 345/100 |
| 5,572,211 | 11/1996 | Erhart et al. | 341/144 |
| 5,574,475 | 11/1996 | Callahan, Jr. et al. | 345/100 |
| 5,604,511 | 2/1997 | Ohi | 345/98 |
| 5,623,277 | 4/1997 | Lippmann et al. | 345/87 |
| 5,650,801 | 7/1997 | Higashi | 345/210 |
| 5,675,352 | 10/1997 | Rich et al. | 345/89 |
| 5,693,237 | 12/1997 | Bodensohn | 216/23 |
| 5,757,351 | 5/1998 | Lin et al. | 345/98 |

FOREIGN PATENT DOCUMENTS

| | | | |
|---|---|---|---|
| 0 391 655 | 10/1990 | European Pat. Off. | G09G 3/36 |
| 0 457 329 | 11/1991 | European Pat. Off. | G09G 3/36 |
| 0 720 140 A2 | 12/1995 | European Pat. Off. | G09G 3/36 |
| 44 46 330 A1 | 7/1995 | Germany | G09G 3/34 |
| 2 136 622 | 2/1984 | United Kingdom . | |
| WO 96/18990 | 6/1996 | WIPO | G90G 3/36 |

OTHER PUBLICATIONS

Fluxman, S. M. "Integrated Active Matrix Liquid Crystal Displays", The GEC Journal of Research; vol. 11, No. 1; pp.2–11,1993.

Okada, H. et al.; "23.1: An 8–bit Digital Data Driver for AMLCDs", SID 94 Digest; 1994; pp. 347–350.

A New Digital Data–Line Circuit For TFT–LCD Driving, May 12, 1996, H. Tsuchi, H. Hayama, NEC Corp., Kanagawa, Japan, SID International Symposium Digest of Technical papers, San Diego, May 12–17, 1996, pp. 251–254.

*Primary Examiner*—Regina Liang

*Attorney, Agent, or Firm*—Fenwick & West LLP

[57] ABSTRACT

To reduce the layout area required by LCD column drivers without suffering a significant decrease in performance, a PMOS-based circuit selects a voltage from an upper set of analog display voltages and a NMOS-based circuit selects a voltage from a lower set of analog display voltages. This reduces the layout area by up to roughly a factor of two compared with conventional column drivers which are CMOS-based. Moreover, in a typical dot inversion scheme, where two adjacent columns select voltages from alternating voltage sets, two adjacent columns can share the same PMOS-based and NMOS-based circuits by using multiplexers controlled by a polarity signal to route the digital display data into the sets of switches. This reduces the layout area by up to roughly an additional factor of two.

23 Claims, 13 Drawing Sheets

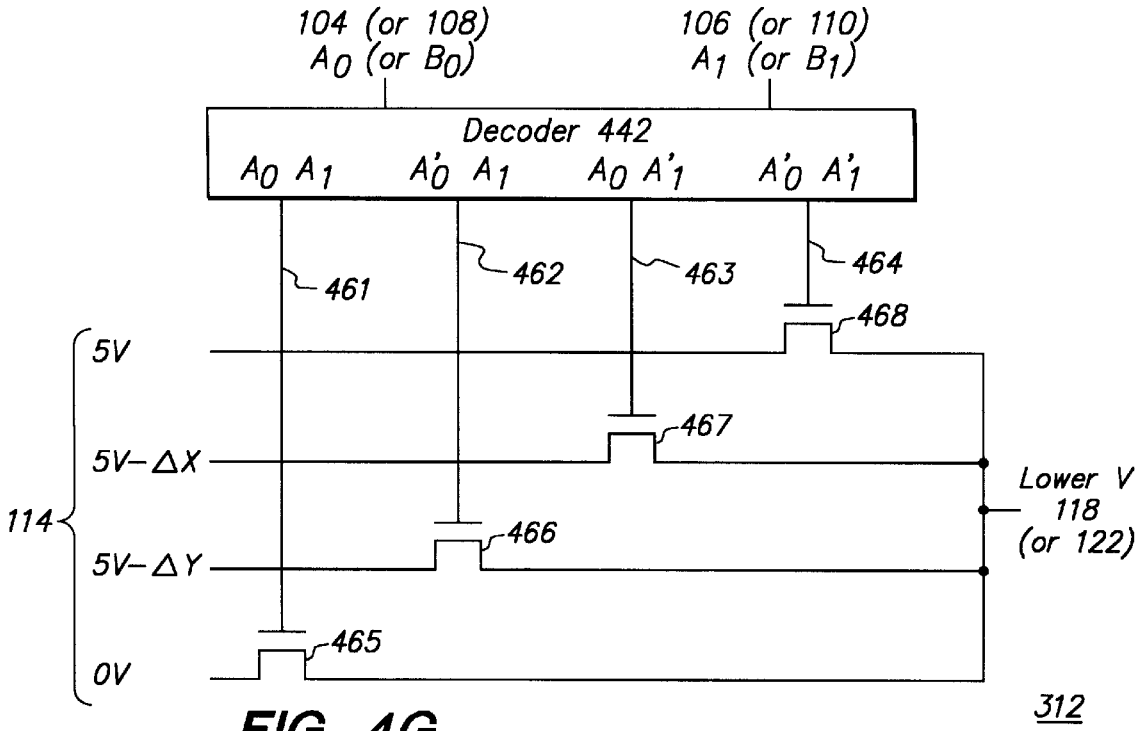
FIG. 4G
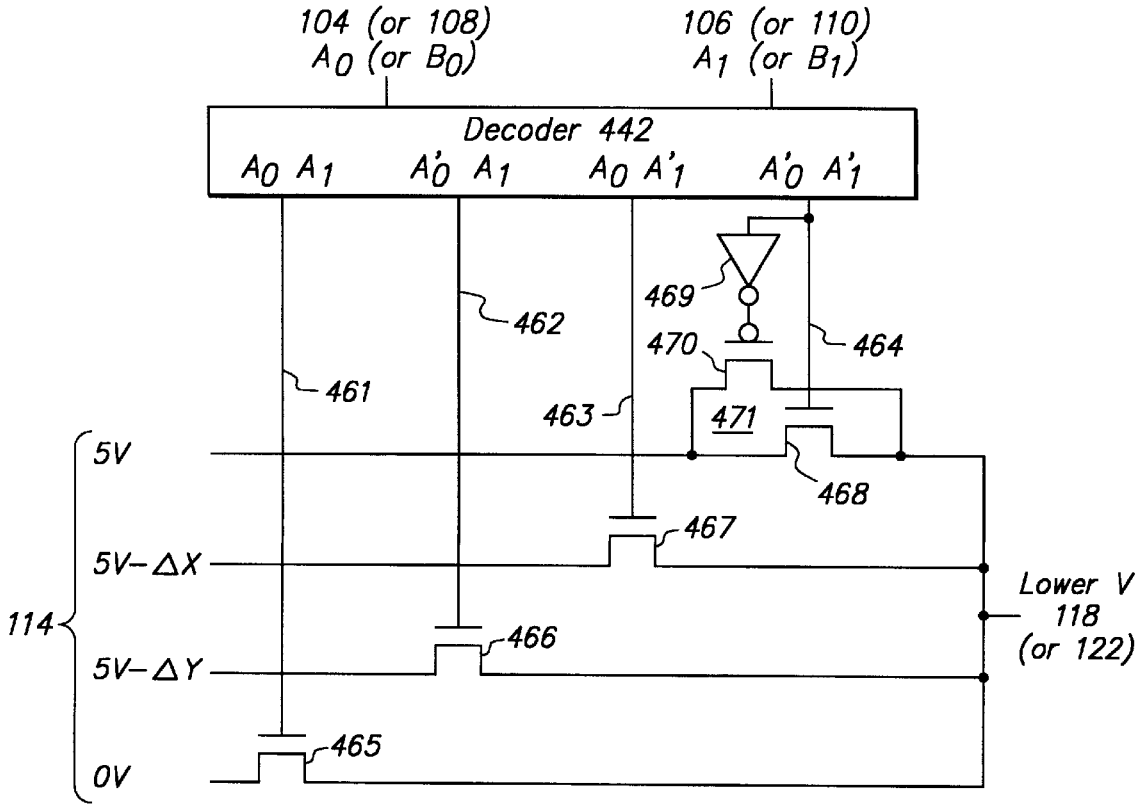
FIH. 4H

900

HIGH DENSITY COLUMN DRIVERS FOR AN ACTIVE MATRIX DISPLAY

I. BACKGROUND OF THE INVENTION

1. Technical Field

This invention relates to electronic circuit designs for high density column drivers for an active matrix (thin-film transistor) liquid crystal display.

2. Description of Related Art

With recent progress in various aspects of active matrix (thin-film transistor) liquid crystal display (LCD) technology, the proliferation of active matrix displays has been spectacular in the past several years. In an active matrix display, there is one transistor or switch corresponding to each display cell. An active matrix display is operated by first applying a selection voltage to a row electrode to activate the gates of that row of cells, and second applying appropriate analog data voltages to the column electrodes to charge each cell in the selected row to a desired voltage level.

Column drivers are very important circuits in the design of an active matrix display panel. The column drivers receive digital display data along with control and timing signals from a display controller chip. The column drivers convert the digital display data to analog display voltages, typically using one CMOS-based circuit per column to perform the conversion. The column drivers then output the analog display voltages onto column electrodes of the display.

As the resolution of LCD flat panel displays (FPDs) increases, the layout area typically required by the column driver circuits increases dramatically. For example, as the resolution of an LCD FPD increases from 6 bits per primary color (for a total of about 256 thousand colors possible) to 8 bits per primary color (for a total of about 16 million colors possible), the layout area typically required increases by a factor of four (due to the two additional bits of shading per primary color).

To alleviate the above described problem, a new circuit and layout scheme for LCD column drivers is needed.

II. SUMMARY

To reduce the layout area required by LCD column drivers without suffering a significant decrease in performance, a PMOS-based circuit selects a voltage from an upper set of analog display voltages and a NMOS-based circuit selects a voltage from a lower set of analog display voltages. This reduces the layout area by up to roughly a factor of two compared with conventional column drivers which are CMOS-based. Moreover, in a typical dot inversion scheme, where two adjacent columns select voltages from alternating voltage sets, two adjacent columns can share the same PMOS-based and NMOS-based circuits by using multiplexers controlled by a polarity signal to route the digital display data into the sets of switches. This reduces the layout area by up to roughly an additional factor of two.

III. BRIEF DESCRIPTION OF THE DRAWINGS

FIG. 4G is a schematic diagram of a third and alternate NMOS-based circuit according to the present invention.

FIG. 4H is a schematic diagram of a fourth and alternate mostly-NMOS-based circuit according to the present invention.

IV. DESCRIPTION OF THE PREFERRED EMBODIMENTS

A. Prior Art (Dot Inversion)

Figure 1:
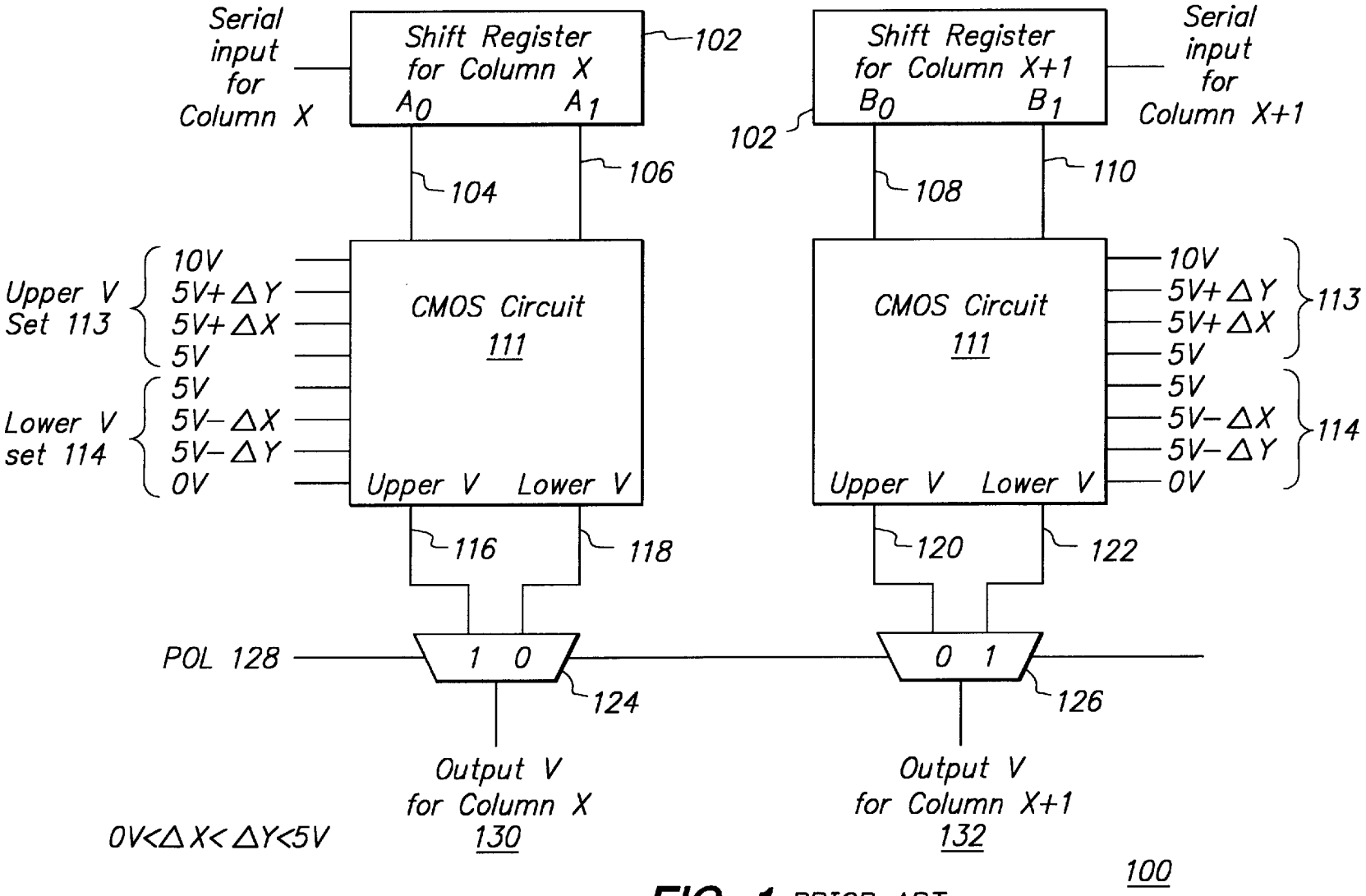
FIG. 1 PRIOR ART
FIG. 1 is a schematic diagram of a first and conventional column driver circuit with a CMOS-based circuit used as a digital-to-analog converter.

FIG. 1 is a schematic diagram of a first and conventional column driver circuit 100 with CMOS-based circuits 111 used as digital-to-analog converters. The first column driver circuit 100 is shown for two adjacent columns of a display, column X and column X+1. For purposes of clarity in this description, a two-bit version of the first column driver circuit 100 is shown.

For each column, a shift register 102 receives serial digital display data from a panel controller chip (not shown) and outputs the digital display data in parallel form to a conventional CMOS-based circuit 111. Since FIG. 1 illustrates a two-bit version of the first column driver circuit 100, each shift register 102 outputs two bits (via two lines). The two bits output by the shift register 102 corresponding to column X are denoted $A_0$ and $A_1$, where $A_0$ is the low order bit, and $A_1$ is the high order bit, of the two-bit digital display value for column X. $A_0$ is output on a first digital line 104, and $A_1$ is output on a second digital line 106. When $A_0$ is low, the first digital line 104 carries 0 volts. When $A_0$ is high, the first digital line 104 carries 10 volts. Similarly, when $A_1$ is low, the second digital line 106 carries 0 volts. When $A_1$ is high, the second digital line 110 carries 10 volts. Both the first 104 and second 106 digital lines connect to a left CMOS-based circuit 111. Similarly, the two bits output by the shift register 102 corresponding to column X+1 are denoted $B_0$ and $B_1$, where $B_0$ is the low order bit and $B_1$ is the high order bit of the two-bit digital display value for column X+1. $B_0$ is output on a third digital line 108, and $B_1$ is output on a fourth digital line 110. Both the third 108 and fourth 110 digital lines connect to a right CMOS-based circuit 111 which is typically identical in design to the left CMOS-based circuit 111.

A group of eight ($2^{n+1}$, where n=the number of bits per digital display value) analog display voltages (i.e., analog reference voltages) is received by each CMOS-based circuit 111. The group of analog display voltages may be divided into two sets: an upper voltage set 113 and a lower voltage set 114. The upper voltage set 113 provides reference voltages at or above a midpoint voltage, while the lower voltage set 114 provides reference voltages at or below the midpoint voltage. The upper and lower voltage sets 113 and 114 are approximately symmetrical across the midpoint voltage, and the midpoint voltage is connected to the backside electrode of the display panel. For the first column driver circuit 100 shown in FIG. 1, the midpoint voltage is five volts (5 V). The upper voltage set 113 comprises: 5 V; 5 V plus ΔX; 5 V plus ΔY and ten volts (10 V). The voltage values for ΔX and ΔY are such that 0 V<ΔX<ΔY<5 V. Similarly, the lower voltage set 114 comprises: 5 V; 5 V minus ΔX; 5 V minus ΔY; and 0 V. The upper 113 and lower 114 voltage sets input into each CMOS-based circuit 111 or 112 are further described below in relation to FIG. 2A.

Each CMOS-based circuit 111 selects an upper voltage from the upper voltage set 113 and a coresponding lower voltage from the lower voltage set 114. The upper voltage selected by the left CMOS-based circuit 111 (for column X) is output on a first analog line 116. The lower voltage selected by the left CMOS-based circuit 111 is output onto a second analog line 118. The upper voltage selected by the right CMOS-based circuit 111 (for column X+1) is output on a third analog line 120. The lower voltage selected by the right CMOS-based circuit 111 is output onto a fourth analog line 122. Two conventional designs for the CMOS-based circuit which is a set of CMOS switches 111 are further described below in relation to FIGS. 2B and 2C.

A first multiplexer 124 and a second multiplexer 126 are controlled by a polarity signal 128. The first 116 and second 118 analog lines connect to the inputs of the first multiplexer 124 so that the first multiplexer 124 can select either the upper voltage on the first analog line 116 or the lower voltage on the second analog line 118 depending on the value of the polarity signal 128. If the polarity signal 128 is high (1), then the first multiplexer 124 selects the upper voltage on the first analog line 116. If the polarity signal 128 is low (0), then the first multiplexer 124 selects the lower voltage on the second analog line 118. Similarly, the third 120 and fourth 122 analog lines connect to the inputs of the second multiplexer 126 so that the second multiplexer 126 can select either the upper voltage on the third analog line 120 or the lower voltage on the fourth analog line 122 depending on the value of the polarity signal 128. If the polarity signal 128 is high (1), then the second multiplexer 126 selects the lower voltage on the fourth analog line 122. If the polarity signal 128 is low (0), then the second multiplexer 126 selects the upper voltage on the third analog line 120.

Thus, when the polarity signal 128 is high (1), the first multiplexer 124 selects an upper voltage while the second multiplexer 126 selects a lower voltage. Similarly, when the polarity signal 128 is low (0), the first multiplexer 124 selects a lower voltage while the second multiplexer 126 selects an upper voltage. This "inversion" between adjacent pixels in a row is done by design in order to reduce display flicker and crosstalk between columns. This inversion scheme is called dot-inversion.

The voltage selected by the first multiplexer 124 is output to the column electrode for column X 130. The voltage selected by the second multiplexer 126 is output to the column electrode for column X+1 132.

For each row selected (activated by application of a selection voltage to the row electrode), the polarity signal 128 applied by the first column driver circuit 100 is either high (1) or low (0). However, between the selection of adjacent rows, the polarity signal 128 is typically switched from high to low, or from low to high. This "inversion" between adjacent rows is done in order to reduce display flicker and crosstalk between rows. This inversion scheme is called line-inversion. A dot-inversion scheme usually incorporates line-inversion as well.

In addition, between the display of adjacent frames (scanning periods), the polarity signal 128 for the first row is typically switched from high to low, or from low to high. This "inversion" between adjacent frames is done in order to reduce display flicker and crosstalk between frames. This inversion scheme is called frame inversion. Most of the LCD based displays use frame inversion.

The first column driver circuit 100 described above has the capability to provide analog voltages both above and below the backside electrode voltage of 5V at the same time, but not all conventional column driver circuits are so enabled. Other conventional column driver circuits, which adopt line inversion, but not dot inversion, can provide analog voltages which alternate between being above and below the backside electrode voltage. This is typically done by flipping the arrangement of analog voltages on the lines in conjunction with alternating the backside voltage between low and high voltages (see FIG. 7, discussed in detail below).

Figure 2A:
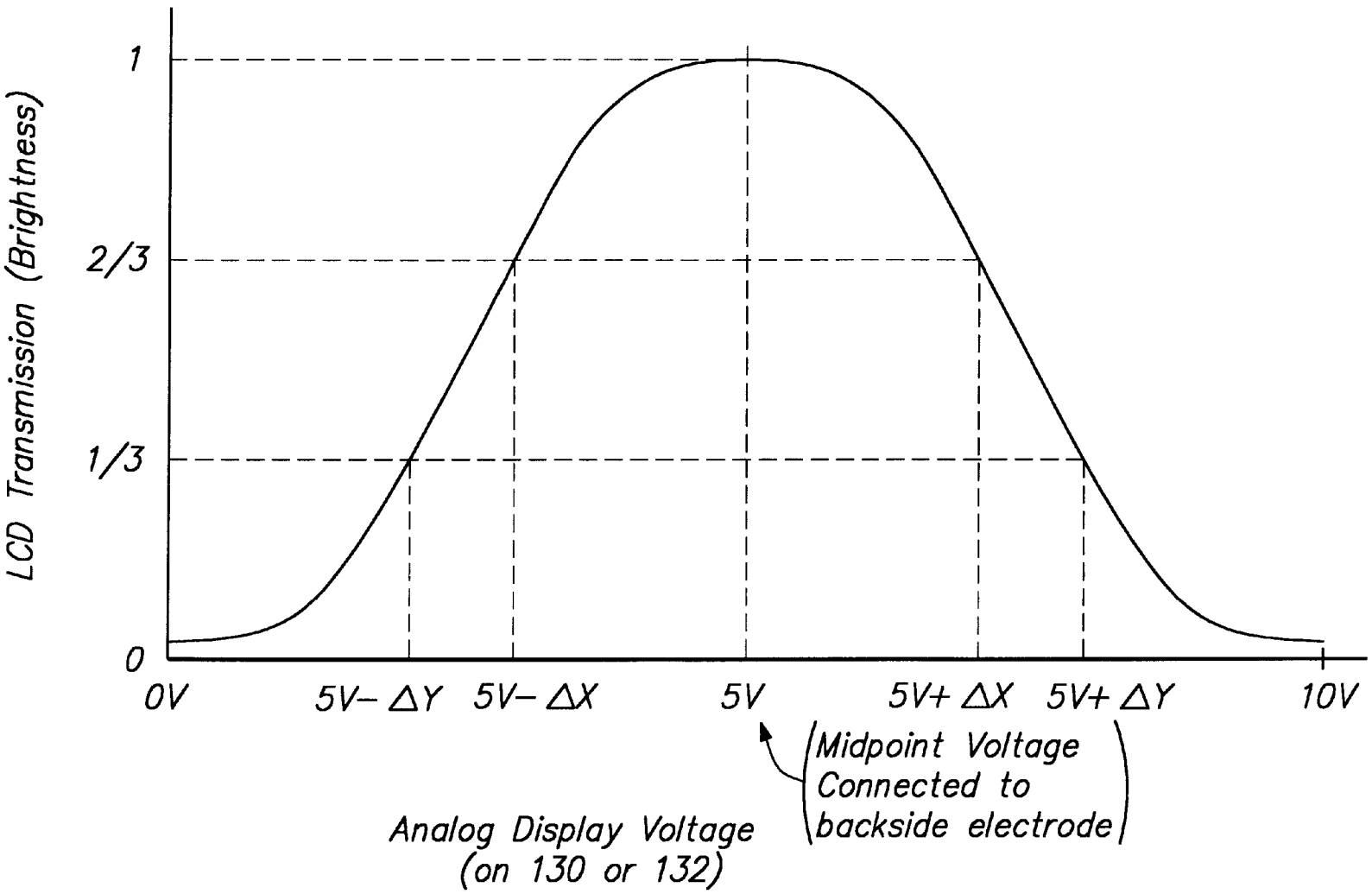
FIG. 2A PRIOR ART
FIG. 2A is an illustrative graph of LCD transmission (brightness) as a function of the analog display voltage on a column electrode.

FIG. 2A is an illustrative graph of LCD transmissivity (brightness) as a function of analog display voltage on a column electrode 130 or 132. The graph depicts a typical nonlinear curve where LCD transmissivity peaks near one when the analog display voltage is at the midpoint voltage (5V) and decreases to about zero as the difference between the analog display voltage and the midpoint voltage increases.

It is desirable to select the upper 113 and lower 114 sets of analog display voltages so that they correspond to transmissivity levels which are relatively evenly spaced. FIG. 2A shows an upper set 113 comprising analog display voltages of 5V, 5V+ΔX, 5V+ΔY, and 10 V that are shown to correspond to transmissivity levels of about 1, ⅔, ⅓, and 0, respectively. FIG. 2A also shows a lower set 114 comprising analog display voltages of 5V, 5V−ΔX, 5V−ΔY, and 0V that are shown to correspond to transmissivity levels of about 1, ⅔, ⅓, and 0, respectively. If the transmissivity function is not symmetrical about the midpoint voltage, the analog display voltages can be adjusted to maintain relatively evenly-spaced transmissivity levels.

Figure 2B:
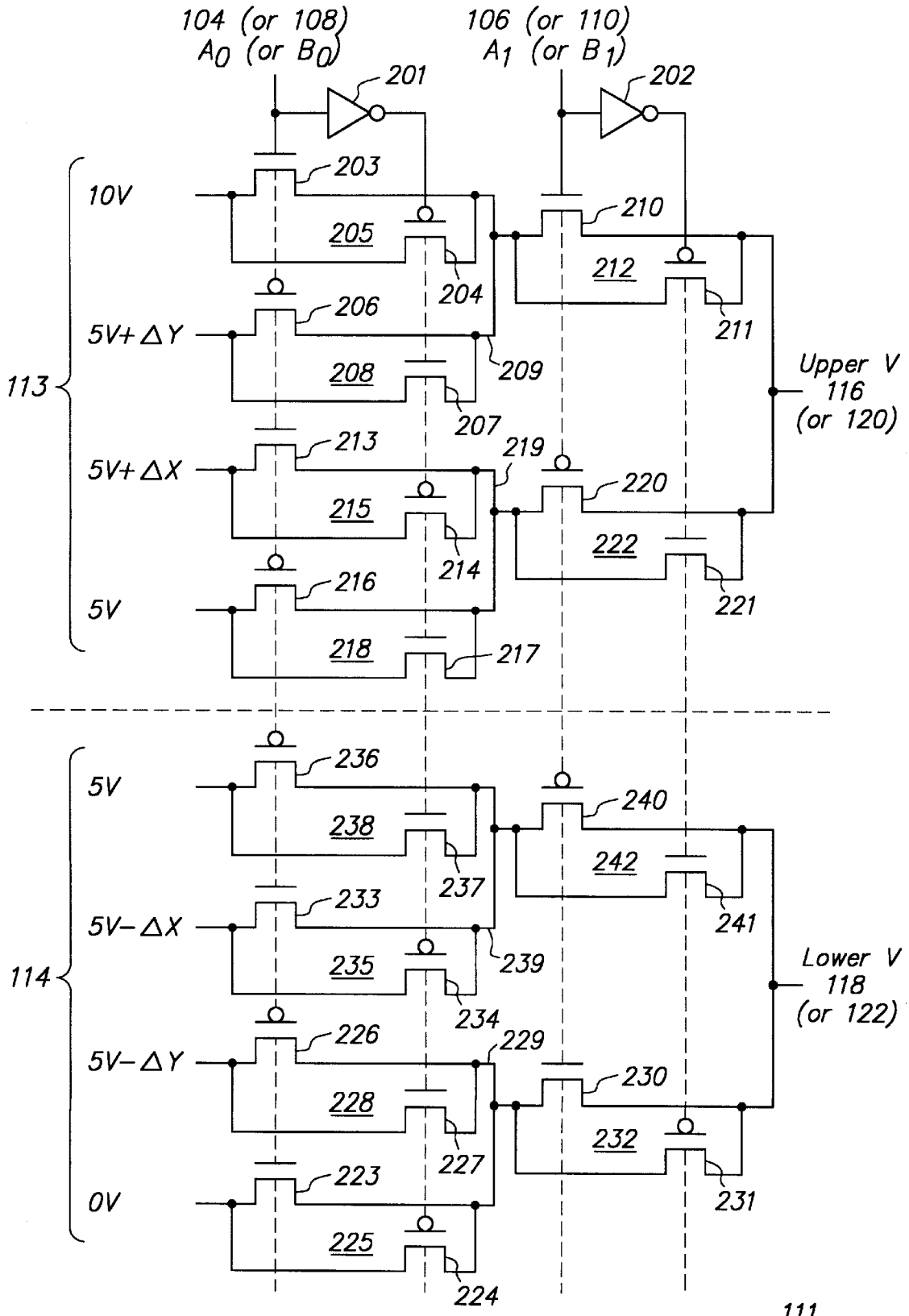
FIG. 2B PRIOR ART
FIG. 2B is a schematic diagram of a first and conventional CMOS-based circuit used as a digital-to-analog converter.

FIG. 2B is a schematic diagram of the first and conventional CMOS-based circuit 111 used as a digital-to-analog converter. The first CMOS-based circuit 111 comprises two inverters 201 and 202, and twelve CMOS switches 205, 208, 212, 215, 218, 222, 225, 228, 232, 235, 238, and 242.

The low order bit $A_0$ for column X (or the low order bit $B_0$ for column X+1) is input along the first digital line 104 (or the third digital line 108) into a first inverter 201 which inverts the low order bit $A_0$ and outputs $A_0'$, where prime denotes an inverse or complement. Similarly, the high order bit $A_1$ for column X (or the high order bit $B^1$ for column X+1) is input along the second digital line 106 (or the fourth digital line 110) into a second inverter 202 which inverts the low order bit $B_0$ and outputs $B_0'$.

Regarding the three CMOS switches 205, 208, and 212 in the top quarter portion of FIG. 2B, the first digital line 104 (or the third digital line 108) is connected to the gate electrode of a first NMOS transistor 203, and the output of the first inverter 201 is connected to the gate electrode of a first PMOS transistor 204. The highest voltage (10 V) in the upper voltage set 113 is connected to the source of both the first NMOS 203 and the first PMOS 204 transistors. Together, the first NMOS transistor 203 and the first PMOS transistor 204 comprise a first CMOS switch 205. When the low order bit $A_0$ is high (1), then the first CMOS switch 205 is "on," meaning that the first CMOS switch 205 drives its output (the drain voltage) to 10 V.

The first digital line 104 is connected to the gate electrode of a second PMOS transistor 206, and the output of the first inverter 201 is connected to the gate electrode of a second NMOS transistor 207. The second highest voltage (5 V+ΔY) in the upper voltage set 113 is connected to the source of both the second PMOS 206 and the second NMOS 207 transistors. Together, the second PMOS 206 and the second NMOS 207 transistors comprise a second CMOS switch 208. When the low order bit $A_0$ is low (0), then the second CMOS switch 208 is "on," meaning that the second CMOS switch 208 drives its output (the drain voltage) to 5 V+ΔY.

The outputs of the first 205 and the second 208 CMOS switches are connected together by a first intermediate line 209. Thus, when the low order bit $A_0$ is high, the first intermediate line 209 is driven by the first CMOS switch 205 to 10 V, and when the low order bit $A_0$ is low, the first intermediate line 209 is driven by the second CMOS switch 208 to 5 V+ΔY.

The second digital line 106 (or the fourth digital line 110) is connected to the gate electrode of a third NMOS transistor 210, and the output of the second inverter 202 is connected to the gate electrode of a third PMOS transistor 211. The first intermediate line 209 is connected to the source of both the third NMOS 210 and the third PMOS 211 transistors. Together, the third NMOS transistor 210 and the third PMOS transistor 211 comprise a third CMOS switch 212. When the high order bit $A_1$ is high (1), then the third CMOS switch 212 is "on," meaning that the third CMOS switch 212 drives its output (the drain voltage) to same voltage as that on the first intermediate line 209.

Regarding the three CMOS switches 215, 218, and 222 in the second-from-the-top quarter portion of FIG. 2B, the first digital line 104 (or the third digital line 108) is connected to the gate electrode of a fourth NMOS transistor 213, and the output of the first inverter 201 is connected to the gate electrode of a fourth PMOS transistor 214. The third highest voltage (5 V+ΔX) in the upper voltage set 113 is connected to the source of both the fourth NMOS 213 and the fourth PMOS 214 transistors. Together, the fourth NMOS transistor 213 and the fourth PMOS transistor 214 comprise a fourth CMOS switch 215. When the low order bit $A_0$ is high (1), then the fourth CMOS switch 215 is "on," meaning that the fourth CMOS switch 215 drives its output (the drain voltage) to 5 V+ΔX.

The first digital line 104 is also connected to the gate electrode of a fifth PMOS transistor 216, and the output of the first inverter 201 is also connected to the gate electrode of a fifth NMOS transistor 217. The lowest voltage 5V in the upper voltage set 113 is connected to the source of both the fifth PMOS 216 and the fifth NMOS 217 transistors. Together, the fifth PMOS 216 and the fifth NMOS 217 transistors comprise a fifth CMOS switch 218. When the low order bit $A_0$ is low (0), then the fifth CMOS switch 218 is "on," meaning that the fifth CMOS switch 218 drives its output (the drain voltage) to 5 V.

The outputs of the fourth 215 and the fifth 218 CMOS switches are connected together by a second intermediate line 219. Thus, when the low order bit $A_0$ is high, the second intermediate line 219 is driven by the fourth CMOS switch 215 to 5 V+ΔX, and when the low order bit $A_0$ is low, the second intermediate line 219 is driven by the fifth CMOS switch 218 to 5 V.

The second digital line 106 (or the fourth digital line 110) is connected to the gate electrode of a sixth PMOS transistor 220, and the output of the second inverter 202 is connected to the gate electrode of a sixth NMOS transistor 221. The second intermediate line 219 is connected to the source of both the sixth PMOS 220 and the sixth NMOS 221 transistors. Together, the sixth PMOS transistor 220 and the sixth NMOS transistor 221 comprise a sixth CMOS switch 222. When the high order bit $A_1$ is low (0), then the sixth CMOS switch 222 is "on," meaning that the sixth CMOS switch 222 drives its output (the drain voltage) to same voltage as that on the second intermediate line 219.

Regarding the output of the top half of FIG. 2B, the output (drain voltage) of both the third CMOS 212 and the sixth CMOS 222 switches are connected to the first analog line 116 (or the third analog line 120). Thus, when $A_0$=1 and $A_1$=1, then 10 V is driven onto the first analog line 116. When $A_0$=0 and $A_1$=1, then 5 V+ΔY is driven onto the first analog line 116. When $A_0$=1 and $A_1$=0, then 5 V+ΔX is driven onto the first analog line 116. Lastly, when $A_0$=0 and $A_1$=0, then 5 V is driven onto the first analog line 116.

Regarding the three CMOS switches 225, 228, and 232 in the bottom quarter portion of FIG. 2B, the first digital line 104 (or the third digital line 108) is connected to the gate electrode of a seventh NMOS transistor 223, and the output of the first inverter 201 is connected to the gate electrode of a seventh PMOS transistor 224. The lowest voltage (0 V) in the lower voltage set 114 is connected to the source of both the seventh NMOS 223 and the seventh PMOS 224 transistors. Together, the seventh NMOS transistor 223 and the seventh PMOS transistor 224 comprise a seventh CMOS switch 225. When the low order bit $A_0$ is high (1), then the seventh CMOS switch 225 is "on," meaning that the seventh CMOS switch 225 drives its output (the drain voltage) to 0 V.

The first digital line 104 is connected to the gate electrode of a eighth PMOS transistor 226, and the output of the first inverter 201 is connected to the gate electrode of a eighth NMOS transistor 227. The second lowest voltage (5 V−ΔY) in the lower voltage set 114 is connected to the source of both the eighth PMOS 226 and the eighth NMOS 227 transistors. Together, the eighth PMOS 226 and the eighth NMOS 227 transistors comprise a eighth CMOS switch 228. When the low order bit $A_0$ is low (0), then the eighth CMOS switch 228 is "on," meaning that the eighth CMOS switch 228 drives its output (the drain voltage) to 5 V−ΔY.

The outputs of the first 225 and the second 228 CMOS switches are connected together by a third intermediate line 229. Thus, when the low order bit $A_0$ is high, the third intermediate line 229 is driven by the seventh CMOS switch 225 to 0 V, and when the low order bit $A_0$ is low, the third intermediate line 229 is driven by the eighth CMOS switch 228 to 5 V−ΔY.

The second digital line 106 (or the fourth digital line 110) is connected to the gate electrode of a ninth NMOS transistor 230, and the output of the second inverter 202 is connected to the gate electrode of a ninth PMOS transistor 231. The third intermediate line 229 is connected to the source of both the ninth NMOS 230 and the ninth PMOS 231 transistors. Together, the ninth NMOS transistor 230 and the ninth PMOS transistor 231 comprise a ninth CMOS switch 232. When the high order bit $A_1$ is high (1), then the ninth CMOS switch 232 is "on," meaning that the ninth CMOS switch 232 drives its output (the drain voltage) to same voltage as that on the third intermediate line 229.

Regarding the three CMOS switches 235, 238, and 242 in the second-from-the-bottom quarter portion of FIG. 2B, the first digital line 104 (or the third digital line 108) is connected to the gate electrode of a tenth NMOS transistor 233, and the output of the first inverter 201 is connected to the gate electrode of a tenth PMOS transistor 234. The third lowest voltage (5 V−ΔX) in the lower voltage set 114 is connected to the source of both the tenth NMOS 233 and the tenth PMOS 234 transistors. Together, the tenth NMOS transistor 233 and the tenth PMOS transistor 234 comprise a tenth CMOS switch 235. When the low order bit $A_0$ is high (1), then the tenth CMOS switch 235 is "on," meaning that the tenth CMOS switch 235 drives its output (the drain voltage) to 5 V−ΔX.

The first digital line 104 is also connected to the gate electrode of a eleventh PMOS transistor 236, and the output of the first inverter 201 is also connected to the gate electrode of a eleventh NMOS transistor 237. The highest voltage 5 V in the lower voltage set 114 is connected to the source of both the eleventh PMOS 236 and the eleventh NMOS 237 transistors. Together, the eleventh PMOS 236 and the eleventh NMOS 237 transistors comprise a eleventh CMOS switch 238. When the low order bit $A_0$ is low (0), then the eleventh CMOS switch 238 is "on," meaning that the eleventh CMOS switch 238 drives its output (the drain voltage) to 5 V.

The outputs of the fourth 235 and the fifth 238 CMOS switches are connected together by a fourth intermediate line 239. Thus, when the low order bit $A_0$ is high, the fourth intermediate line 239 is driven by the tenth CMOS switch 235 to 5 V−ΔX, and when the low order bit $A_0$ is low, the fourth intermediate line 239 is driven by the eleventh CMOS switch 238 to 5 V.

The second digital line 106 (or the fourth digital line 108) is connected to the gate electrode of a twelfth PMOS transistor 240, and the output of the second inverter 202 is connected to the gate electrode of a twelfth NMOS transistor 241. The fourth intermediate line 239 is connected to the source of both the twelfth PMOS 240 and the twelfth NMOS 241 transistors. Together, the twelfth PMOS transistor 240 and the twelfth NMOS transistor 241 comprise a twelfth CMOS switch 242. When the high order bit $A_1$ is low (0), then the twelfth CMOS switch 242 is "on," meaning that the twelfth CMOS switch 242 drives its output (the drain voltage) to same voltage as that on the fourth intermediate line 239.

Regarding the output of the bottom half of FIG. 2B, the output (drain voltage) of both the ninth CMOS 232 and the twelfth CMOS 242 switches are connected to the second analog line 118 (or the fourth analog line 122). Thus, when $A_0$=1 and $A_1$=1, then 0 V is driven onto the second analog line 118. When $A_0$=0 and $A_1$=1, then 5 V−ΔY is driven onto the second analog line 118. When $A_0$=1 and $A_1$=0, then 5 V−ΔX is driven onto the second analog line 118. Lastly, when $A_0$=0 and $A_1$=0, then 5 V is driven onto the second analog line 118.

Figure 2C:
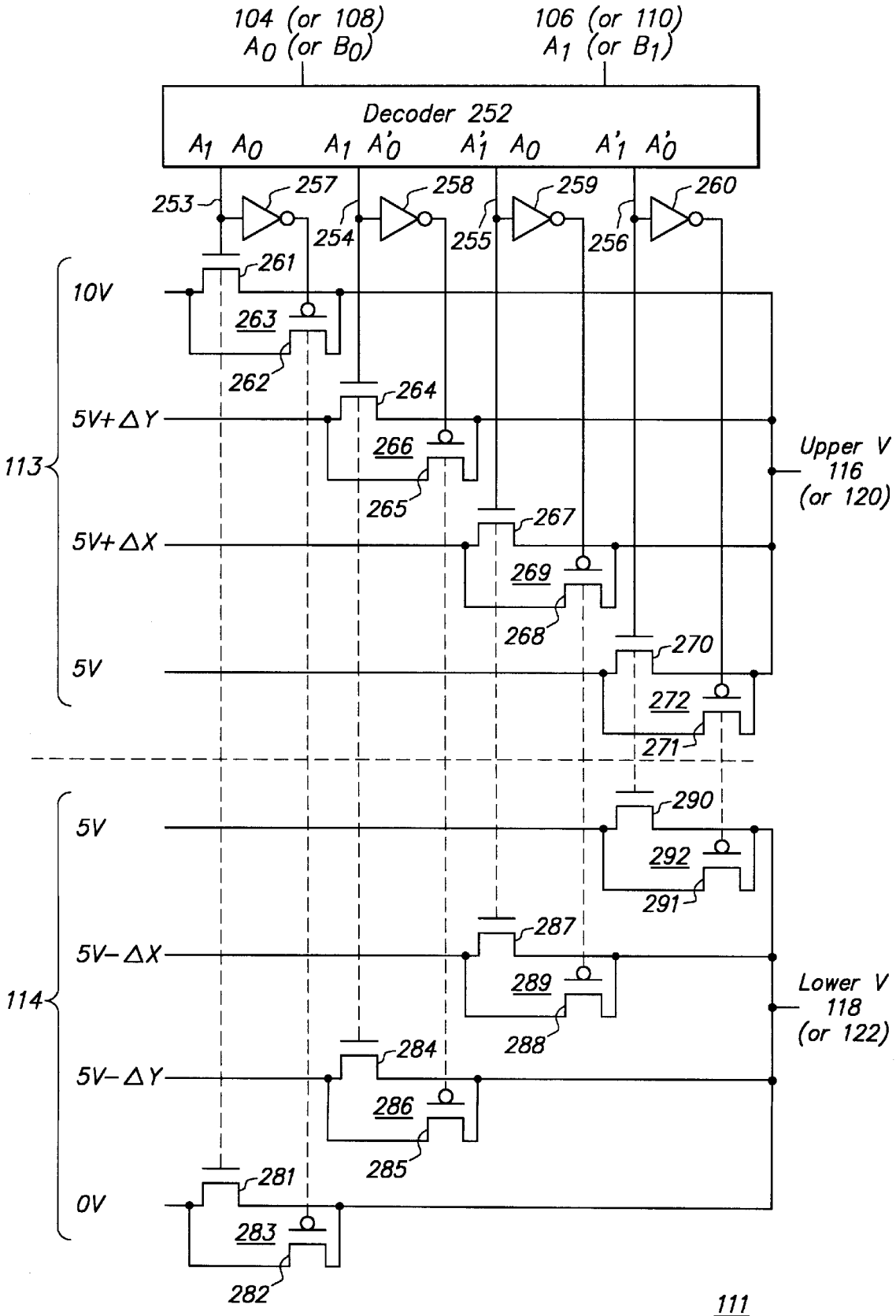
FIG. 2C PRIOR ART
FIG. 2C is a schematic diagram of a second and conventional CMOS-based circuit with a decoder circuit.

FIG. 2C is a schematic diagram of a second and conventional CMOS-based circuit 111 with a decoder circuit 252. The second CMOS-based circuit 111 comprises a decoder circuit 252, four inverters 257–260, and eight CMOS switches 263, 266, 269, 272, 283, 286, 289, and 292.

The decoder circuit 252 receives the low order bit $A_0$ for column X along the first digital line 104 and the high order bit $A_1$ for column X along the second digital line 106 (or the low order bit $B_0$ for column X+1 along the third digital line 108 and the high order bit $B_1$ for column X+1 along the fourth digital line 110). The decoder circuit 252 performs a logical AND operation on the high order bit $A_1$ and the low order bit $A_0$, and it outputs the result $A_1A_0$ on a first decoded line 253. The decoder circuit 252 also performs a logical AND operation on the high order bit $A_1$ and the complement of the low order bit $A_0$, and it outputs the result $A_1A_0'$ (where prime denotes the complement) on a second decoded line 254. The decoder circuit 252 also performs a logical AND operation on the complement of the high order bit $A_1$ and the low order bit $A_0$, and it outputs the result $A_1'A_0$ on a third decoded line 255. The decoder circuit 252 also performs a logical AND operation on the complement of the high order bit $A_1$ and the complement of the low order bit $A_0$, and it outputs the result $A_1'A_0'$ on a fourth decoded line 256.

The result $A_1A_0$ on the first decoded line 253 is input into a first inverter 257 which outputs the complement of $A_1A_0$, i.e. it outputs ($A_1A_0$). The result $A_1A_0$ on the second decoded line 254 is input into a second inverter 258 which outputs ($A_1A_0'$). The result $A_1A_0$ on the third decoded line 255 is input into a third inverter 259 which outputs ($A_1'A_0$). The result $A_1A_0$ on the fourth decoded line 256 is input into a fourth inverter 260 which outputs ($A_1'A_0'$).

Regarding the four CMOS switches 263, 266, 269, and 272 in the top half of FIG. 2C, the first decoded line 253 is connected to the gate electrode of a first NMOS transistor 261, and the output of the first inverter 257 is connected to the gate of a first PMOS transistor 262. The highest voltage (10 V) in the upper voltage set 113 is connected to the source of both the first NMOS 261 and the first PMOS 262 transistors. Together, the first NMOS transistor 261 and the first PMOS transistor 262 comprise a first CMOS switch 263. When the first decoded line 253 is high (i.e., $A_0$=1 AND $A_1$=1), then the first CMOS switch 263 is "on," meaning that the first CMOS switch 263 drives its output (the drain voltage) to 10 V.

The second decoded line 254 is connected to the gate electrode of a second NMOS transistor 264, and the output of the second inverter 258 is connected to the gate of a second PMOS transistor 265. The second highest voltage (5 V+ΔY) in the upper voltage set 113 is connected to the source of both the second NMOS 264 and the second PMOS 265 transistors. Together, the second NMOS transistor 264 and the second PMOS transistor 265 comprise a second CMOS switch 266. When the second decoded line 254 is high (i.e., $A_0$=0 AND $A_1$=1), then the second CMOS switch 266 is "on," meaning that the second CMOS switch 266 drives its output (the drain voltage) to 5 V+ΔY.

The third decoded line 255 is connected to the gate electrode of a third NMOS transistor 267, and the output of the third inverter 259 is connected to the gate of a third PMOS transistor 268. The third highest voltage (5 V+ΔX) in the upper voltage set 113 is connected to the source of both the third NMOS 267 and the third PMOS 268 transistors. Together, the third NMOS transistor 267 and the third PMOS transistor 268 comprise a third CMOS switch 269. When the third decoded line 255 is high (i.e., $A_0$=1 AND $A_1$=0), then the third CMOS switch 269 is "on," meaning that the third CMOS switch 269 drives its output (the drain voltage) to 5 V+ΔX.

The fourth decoded line 256 is connected to the gate electrode of a fourth NMOS transistor 270, and the output of the fourth inverter 260 is connected to the gate of a fourth PMOS transistor 271. The lowest voltage 5 V in the upper voltage set 113 is connected to the source of both the fourth NMOS 270 and the fourth PMOS 271 transistors. Together, the fourth NMOS transistor 270 and the fourth PMOS transistor 271 comprise a fourth CMOS switch 272. When the fourth decoded line 256 is high (i.e., $A_0$=0 AND $A_1$=0), then the fourth CMOS switch 272 is "on," meaning that the fourth CMOS switch 272 drives its output (the drain voltage) to 5 V.

Regarding the output of the top half of FIG. 2C, the outputs (drain voltage) of the first 263, second 266, third 269, and fourth 272 CMOS switches are all connected to the first analog line 116 (or the third analog line 120). Thus, when $A_0$1 and $A_1$=1, then 10 V is driven onto the first analog line 116. When $A_0$=0 and $A_1$=1, then 5V+ΔY is driven onto the first analog line 116. When $A_0$=1 and $A_1$=0, then 5 V+ΔX is driven onto the first analog line 116. Lastly, when $A_0$=0 and $A_1$=0, then 5 V is driven onto the first analog line 116.

Regarding the four CMOS switches 283, 286, 289, and 292 in the bottom half of FIG. 2C, the first decoded line 253 is connected to the gate electrode of a fifth NMOS transistor 281, and the output of the first inverter 257 is connected to the gate of a fifth PMOS transistor 282. The lowest voltage (0 V) in the lower voltage set 114 is connected to the source of both the fifth NMOS 281 and the fifth PMOS 282 transistors. Together, the fifth NMOS transistor 281 and the fifth PMOS transistor 282 comprise a fifth CMOS switch 283. When the first decoded line 253 is high (i.e., $A_0$=1 AND $A_1$=1), then the fifth CMOS switch 283 is "on," meaning that the fifth CMOS switch 283 drives its output (the drain voltage) to 0 V.

The second decoded line 254 is connected to the gate electrode of a sixth NMOS transistor 284, and the output of the second inverter 258 is connected to the gate of a sixth PMOS transistor 285. The second lowest voltage (5 V−ΔY) in the lower voltage set 114 is connected to the source of both the sixth NMOS 284 and the sixth PMOS 285 transistors. Together, the sixth NMOS transistor 284 and the sixth PMOS transistor 285 comprise a sixth CMOS switch 286. When the second decoded line 254 is high (i.e., $A_0$=0 AND $A_1$=1), then the sixth CMOS switch 286 is "on," meaning that the sixth CMOS switch 286 drives its output (the drain voltage) to 5V−ΔY.

The third decoded line 255 is connected to the gate electrode of a seventh NMOS transistor 287, and the output of the third inverter 259 is connected to the gate of a seventh PMOS transistor 288. The third lowest voltage (5 V−ΔX) in the lower voltage set 114 is connected to the source of both the seventh NMOS 287 and the seventh PMOS 288 transistors. Together, the seventh NMOS transistor 287 and the seventh PMOS transistor 288 comprise a seventh CMOS switch 289. When the third decoded line 255 is high (i.e., $A_0$=1 AND $A_1$=0), then the seventh CMOS switch 289 is "on," meaning that the seventh CMOS switch 289 drives its output (the drain voltage) to 5 V−ΔX.

The fourth decoded line 256 is connected to the gate electrode of a eighth NMOS transistor 290, and the output of the fourth inverter 260 is connected to the gate of a eighth PMOS transistor 291. The highest voltage 5 V in the lower voltage set 114 is connected to the source of both the eighth NMOS 290 and the eighth PMOS 291 transistors. Together, the eighth NMOS transistor 290 and the eighth PMOS transistor 291 comprise a eighth CMOS switch 292. When the fourth decoded line 256 is high (i.e., $A_0$=0 AND $A_1$=0), then the eighth CMOS switch 292 is "on," meaning that the eighth CMOS switch 292 drives its output (the drain voltage) to 5 V.

Regarding the output of the bottom half of FIG. 2C, the outputs (drain voltage) of the fifth 283, sixth 286, seventh 289, and eighth 292 CMOS switches are all connected to the second analog line 118 (or the fourth analog line 122). Thus, when $A_0$=1 and $A_1$=1, then 0 V is driven onto the second analog line 118. When $A_0$=0 and $A_1$=1, then 5 V−ΔY is driven onto the second analog line 118. When $A_0$=1 and $A_1$=0, then 5 V−ΔX is driven onto the second analog line 118. Lastly, when $A_0$=0 and $A_1$=0, then 5 V is driven onto the second analog line 118.

B. Present Invention (Dot Inversion)

Figure 3:
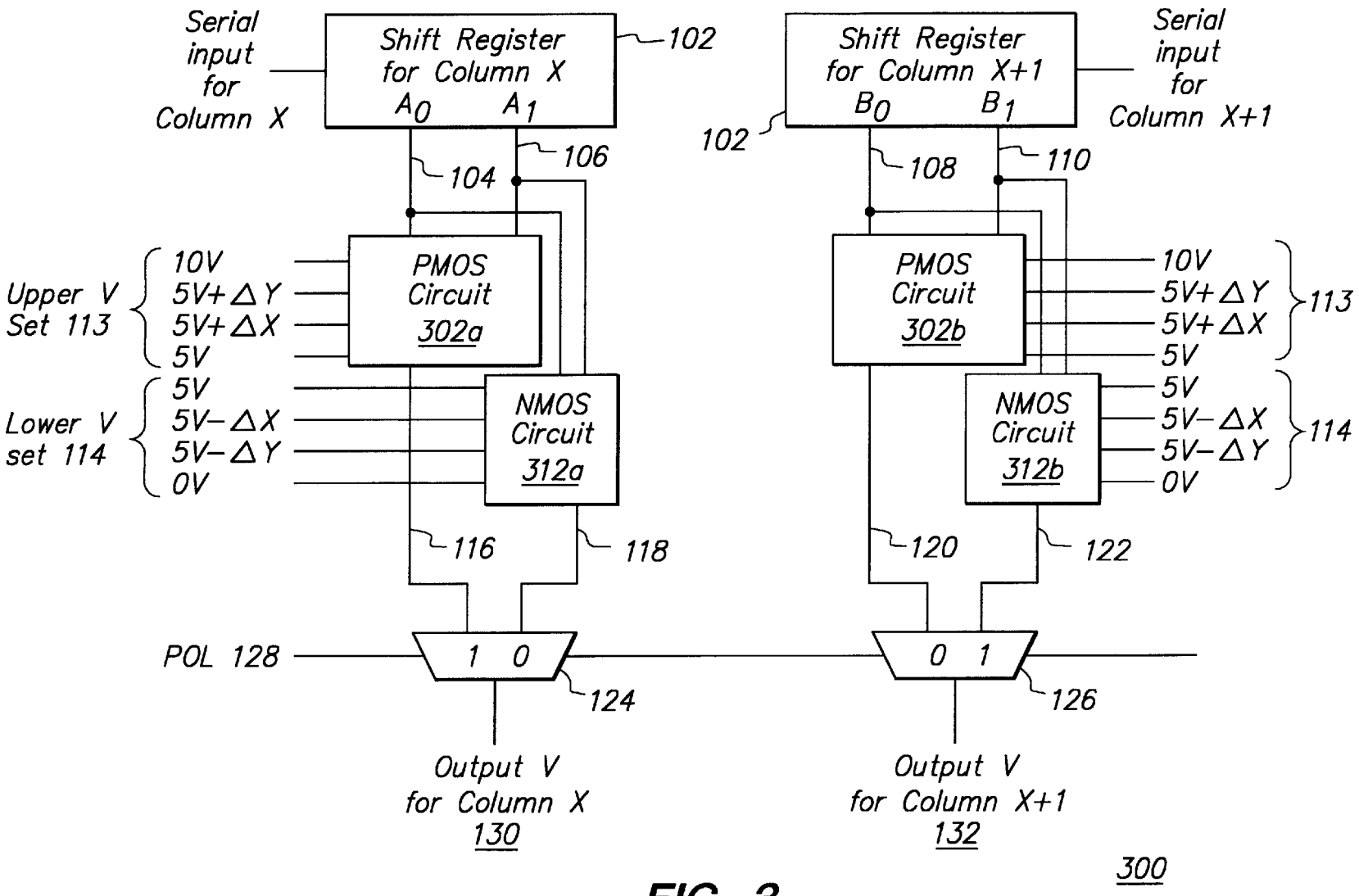
FIG. 3 is a schematic diagram of a second and alternate column driver circuit with a PMOS-based circuit and a NMOS-based circuit according to the present invention.

FIG. 3 is a schematic diagram of a second column driver circuit 300 with a PMOS-based circuit 302 and a NMOS-based circuit 312 according to the present invention. The second column driver circuit 300 is shown for two adjacent columns of a display, column X and column X+1. For purposes of clarity in this description, a two-bit version of the second column driver circuit 300 is shown.

For each column, a shift register 102 receives serial digital display data from a panel controller chip (not shown) and outputs the digital display data in parallel form to a PMOS-based circuit 302 and a NMOS-based circuit 312. Since FIG. 3 illustrates a two-bit version of the second column driver circuit 300, each shift register 102 outputs two bits (via two lines). The two bits output by the shift register 102 corresponding to column X are denoted $A_0$ and $A_1$, where $A_0$ is the low order bit, and $A_1$ is the high order bit, of the two-bit digital display value for column X. Those skilled in the art would understand how this could be expanded for any number of columns (X+2, X+3, . . . , X+n) and the description of only tow columns is provided for clarity and ease of understanding. $A_0$ is output on a first digital line 104, and $A_1$ is output on a second digital line 106. The first digital line 104 connects to a first input of a left PMOS-based circuit 302*a* (for column X) and to a first input of a left NMOS-based circuit 312*a* (for column X). The second digital line 106 connects to a second input of the left PMOS-based circuit 302*a* and to a second input of the left NMOS-based circuit 312*a*. Similarly, the two bits output by the shift register 102 corresponding to column X+1 are denoted $B_0$ and $B_1$, where $B_0$ is the low order bit, and $B_1$ is the high order bit, of the two-bit digital display value for column X+1. $B_0$ is output on a third digital line 108, and $B_1$ is output on a fourth digital line 110. The third digital line 108 connects to a first input of a right PMOS-based circuit 302*b* (for column X+1) and to a first input of a right NMOS-based circuit 312*b* (for column X+1). The fourth digital line 110 connects to a second input of the right PMOS-based circuit 302*b* and to a second input of the right NMOS-based circuit 312*b*.

An upper voltage set 113 of four ($2^n$, where n=the number of bits per digital display value) analog display voltages (i.e., analog reference voltages) at or above a midpoint voltage is received by each PMOS-based circuit 302. For the second column driver circuit 300 shown in FIG. 3, the midpoint voltage is five volts (5 V) and the upper voltage set 113 comprises: 5 V; 5 V plus ΔX; 5 V plus ΔY and 10 V. The voltage values for ΔX and ΔY are such that 0 V<ΔX<ΔY<5 V. PMOS switches are typically good at switching such upper voltage levels. Similarly, a lower voltage set 114 of four ($2^n$, where n=the number of bits per digital display value) analog display voltages (i.e., analog reference voltages) at or below the midpoint voltage is received by each NMOS-based circuit 302. For the second column driver circuit 300 shown in FIG. 3, the lower voltage set 114 comprises: 5 V; 5 V minus ΔX; 5 V minus ΔY and 0 V. NMOS switches are typically good at switching such lower voltage levels. The upper and lower voltage sets 113 and 114 are approximately symmetrical about the midpoint voltage and are further described above in relation to FIG. 2A.

Each PMOS-based circuit 302 selects an upper voltage from the upper voltage set 113. The left PMOS-based circuit 302 (for column X) outputs the selected upper voltage onto a first analog line 116, and the right PMOS-based circuit 302 (for column X+1) outputs the selected upper voltage onto a third analog line 120. Similarly, each NMOS-based circuit 312 selects a lower voltage from the lower voltage set 114. The left NMOS-based circuit 312 (for column X) outputs the selected lower voltage onto a second analog line 118, and the right NMOS-based circuit 312 (for column X+1) outputs the selected lower voltage onto a fourth analog line 122. Four designs each for the sets of PMOS 302 and NMOS 312 switches are further described below in relation to FIGS. 4A–H.

The first 116 and second 118 analog lines connect to the inputs of the first multiplexer 124 so that the first multiplexer 124 can select either the upper voltage on the first analog line 116 or the lower voltage on the second analog line 118 depending on the value of a polarity signal 128. If the polarity signal 128 is high (1), then the first multiplexer 124 selects the upper voltage on the first analog line 116. If the polarity signal 128 is low (0), then the first multiplexer 124 selects the lower voltage on the second analog line 118. Similarly, the third 120 and fourth 122 analog lines connect to the inputs of a second multiplexer 126 so that the second multiplexer 126 can select either the upper voltage on the third analog line 120 or the lower voltage on the fourth analog line 122 depending on the value of the polarity signal 128. If the polarity signal 128 is high (1), then the second multiplexer 126 selects the lower voltage on the fourth analog line 122. If the polarity signal 128 is low (0), then the second multiplexer 126 selects the upper voltage on the third analog line 120.

Thus, when the polarity signal 128 is high (1), the first multiplexer 124 selects an upper voltage while the second multiplexer 126 selects a lower voltage. Similarly, when the polarity signal 128 is low (0), the first multiplexer 124 selects a lower voltage while the second multiplexer 126 selects an upper voltage. This "dot inversion" between adjacent pixels in a row is done by design in order to reduce display flicker and crosstalk between columns.

The voltage selected by the first multiplexer 124 is output to the column electrode for column X 130. The voltage selected by the second multiplexer 126 is output to the column electrode for column X+1 132.

For each row selected (activated by application of a selection voltage to the row electrode), the polarity signal 128 applied by the second column driver circuit 300 is either high (1) or low (0). However, between the selection of adjacent rows, the polarity signal 128 is typically switched from high to low, or from low to high. This "line inversion" between adjacent rows is done in order to reduce display flicker and crosstalk between rows.

In addition, between the display of adjacent frames (scanning periods), the polarity signal 128 for the first row is typically switched from high to low, or from low to high. This "frame inversion" between adjacent frames is done in order to reduce display flicker and crosstalk between frames.

An advantage that the second column driver circuit 300 has over the first column driver circuit 100 is that the second column driver circuit 300 takes up less layout area than the first column driver circuit 100 without incurring significant accuracy degradation. This is because the second column driver circuit 300 uses either PMOS or NMOS transistors as switches, while the first column driver circuit 100 uses full CMOS (PMOS+NMOS) transistor switches (which are twice as large). Thus, the design of the second column driver circuit 300 eliminates unnecessary transistors.

Figure 4A:
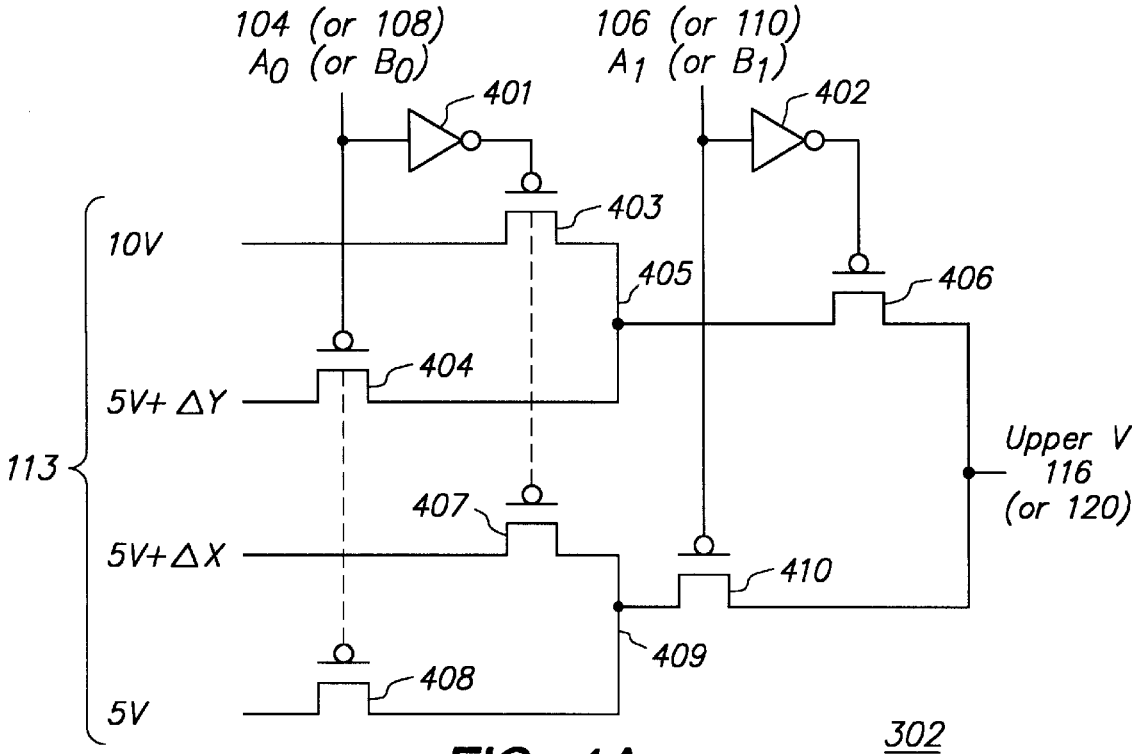
FIG. 4A is a schematic diagram of a first and preferred PMOS-based circuit according to the present invention.

FIG. 4A is a schematic diagram of a first and preferred PMOS-based circuit 302 according to the present invention. The first PMOS-based circuit 302 comprises two inverters 401 and 402 and six enhancement-type PMOS switches 403, 404, 406, 407, 408, and 410.

The low order bit $A_0$ for column X (or the low order bit $B_0$ for column X+1) is input along the first digital line 104 (or the third digital line 108) into a first inverter 401 which inverts the low order bit $A_0$ and outputs $A_0'$, where prime denotes an inverse or complement of. Similarly, the high order bit $A_1$ for column X (or the high order bit $B_1$ for column X+1) is input along the second digital line 106 (or the fourth digital line 110) into a second inverter 402 which inverts the low order bit $A_1$ and outputs $A_1'$.

Regarding the three enhancement-type PMOS switches 403, 404, and 406 in the top half of FIG. 4A, the output of the first inverter 401 is connected to the gate electrode of a first PMOS transistor (or switch) 403. The highest voltage (10 V) in the upper voltage set 113 is connected to the source of the first PMOS 404 switch. When the low order bit $A_0$ is high (1), then the first PMOS switch 403 is "on," meaning that the first PMOS switch 403 drives its output (the drain voltage) to 10 V.

The first digital line 104 (or the third digital line 108) is connected to the gate electrode of a second PMOS transistor (or switch) 404. The second highest voltage (5 V+ΔY) in the upper voltage set 113 is connected to the source of the second PMOS switch 404. When the low order bit $A_0$ is low (0), then the second PMOS switch 404 is "on," meaning the second PMOS switch 404 drives its output (the drain voltage) to 5 V+ΔY.

The outputs of the first 403 and the second 404 PMOS switches are connected together by a first intermediate line 405. Thus, when the low order bit $A_0$ is high, the first intermediate line 405 is driven by the first PMOS switch 403 to 10 V, and when the low order bit $A_0$ is low, the first intermediate line 405 is driven by the second PMOS switch 404 to 5 V+ΔY.

The output of the second inverter 402 is connected to the gate electrode of a third PMOS transistor (or switch) 406. The first intermediate line 405 is connected to the source of the third PMOS switch 406. When the high order bit $A_1$ is high (1), then the third PMOS switch 406 is "on," meaning that the third PMOS switch 406 drives its output (the drain voltage) to same voltage as that on the first intermediate line 405.

Regarding the three enhancement-type PMOS switches 407, 408, and 410 in the top half of FIG. 4A, the output of the first inverter 401 is connected to the gate electrode of a fourth PMOS transistor (or switch) 407. The third highest voltage (5 V+ΔX) in the upper voltage set 113 is connected to the source of the fourth PMOS 407 switch. When the low order bit $A_0$ is high (1), then the fourth PMOS switch 407 is "on," meaning that the fourth PMOS switch 407 drives its output (the drain voltage) to 5 V+ΔX.

The first digital line 104 (or the third digital line 108) is connected to the gate electrode of a fifth PMOS transistor (or switch) 408. The lowest voltage (5 V) in the upper voltage set 113 is connected to the source of the fifth PMOS switch 408. When the low order bit $A_0$ is low (0), then the fifth PMOS switch 408 is "on," meaning the fifth PMOS switch 408 drives its output (the drain voltage) to 5 V.

The outputs of the fourth 407 and the fifth 408 PMOS switches are connected together by a second intermediate line 409. Thus, when the low order bit $A_0$ is high, the second intermediate line 409 is driven by the fourth PMOS switch 407 to 5 V+ΔX, and when the low order bit $A_0$ is low, the second intermediate line 409 is driven by the fifth PMOS switch 408 to 5 V.

The output of the second inverter 402 is connected to the gate electrode of a sixth PMOS transistor (or switch) 410. The second intermediate line 409 is connected to the source of the sixth PMOS switch 410. When the high order bit $A_1$ is low (0), then the sixth PMOS switch 410 is "on," meaning that the sixth PMOS switch 410 drives its output (the drain voltage) to same voltage as that on the second intermediate line 409.

Regarding the output of the first PMOS-based circuit 302, the output (drain voltage) of both the third PMOS 406 and sixth PMOS 410 switches are connected to the first analog line 116 (or the third analog line 120). Thus, when $A_0$=1 and $A_1$=1, then 10 V is driven onto the first analog line 116. When $A_0$=0 and $A_1$1, then 5 V+ΔY is driven onto the first analog line 116. When $A_0$=1 and $A_1$=0, then 5 V+ΔX is driven onto the first analog line 116. Lastly, when $A_0$=0 and $A_1$=0, then 5 V is driven onto the first analog line 116.

Therefore, this PMOS circuit for selecting the upper voltage is advantageous because the number of transistors is reduced by almost one-half compared to a similar circuit of CMOS transistors.

Figure 4B:
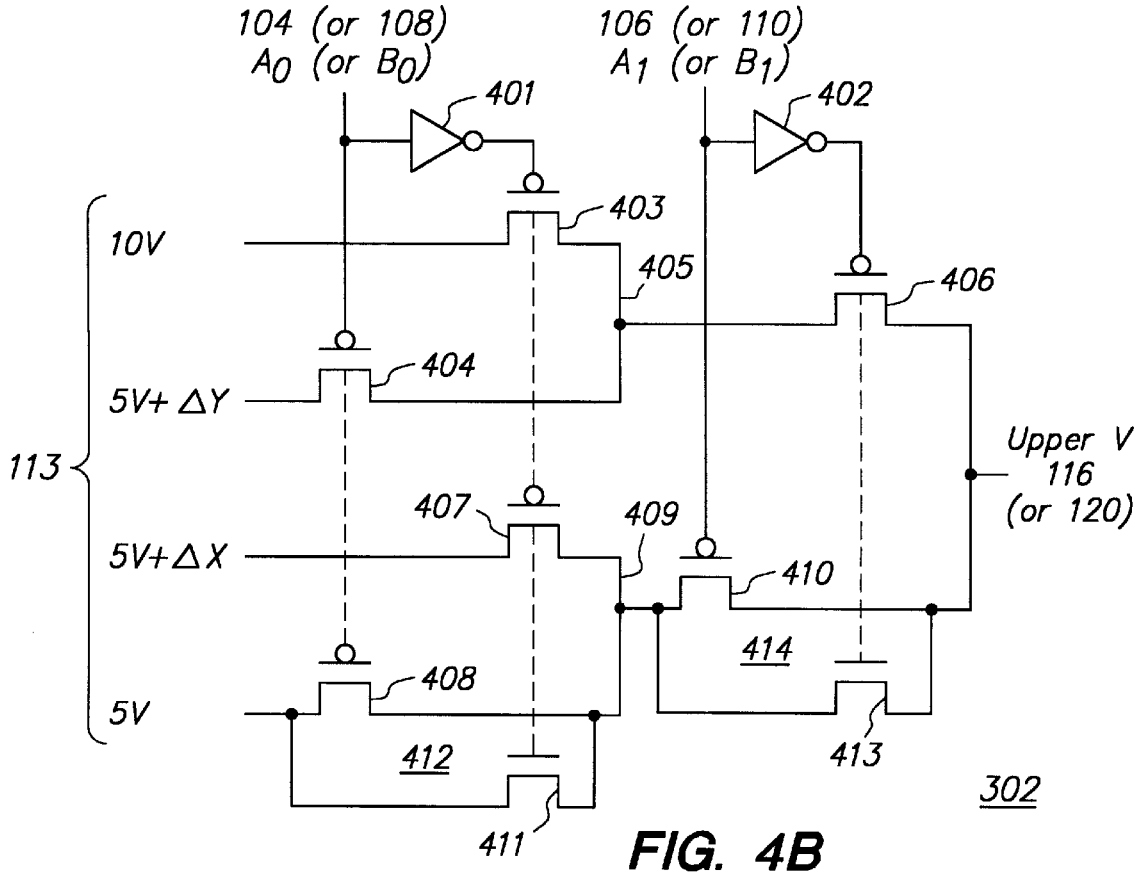
FIG. 4B is a schematic diagram of a second and alternate mostly-PMOS-based circuit according to the present invention.

FIG. 4B is a schematic diagram of a second and alternate PMOS-based circuit 302 according to the present invention. The second PMOS-based circuit 302 is similar to the first PMOS-based circuit 302 in FIG. 4A, except that enhancement-type NMOS transistors are selectively added in parallel to those enhancement-type PMOS transistors that transmit voltages at or near the midpoint voltage.

In this embodiment, the gate of a first enhancement-type NMOS transistor 411 receives $A_0$ from the output of the first inverter 401. The source of the first NMOS transistor 411 receives 5V from the upper voltage set 113. The drain of the first NMOS transistor 411 is connected to the second intermediate line 409.

The first NMOS transistor 411 together with the fifth PMOS transistor 408 forms a first CMOS switch 412. When $A_0$=0, the first CMOS switch 412 transmits 5 V and does so better than the fifth PMOS transistor 408 alone.

Similarly, a second enhancement-type NMOS transistor 413 is added in parallel to the sixth PMOS transistor 410 to form a second CMOS switch 414. When $A_0$=0 and $A_1$=0, the second CMOS switch 414 transmits 5 V and does so better than the sixth PMOS transistor 410 alone.

The addition of NMOS transistors in parallel to the first through fourth enhancement-type PMOS transistors 403, 404, 406, and 407 is not typically necessary. This is because an enhancement-type PMOS transistor typically conducts sufficiently well the higher voltages required to be transmitted by these upper transistors 403, 404, 406, and 407.

Therefore, with the addition of select NMOS transistors, the PMOS-based circuit still has significantly fewer transistors than a similar circuit of CMOS transistors. The select additional NMOS transistors enhance transmission of voltages near the midpoint.

Figure 4C:
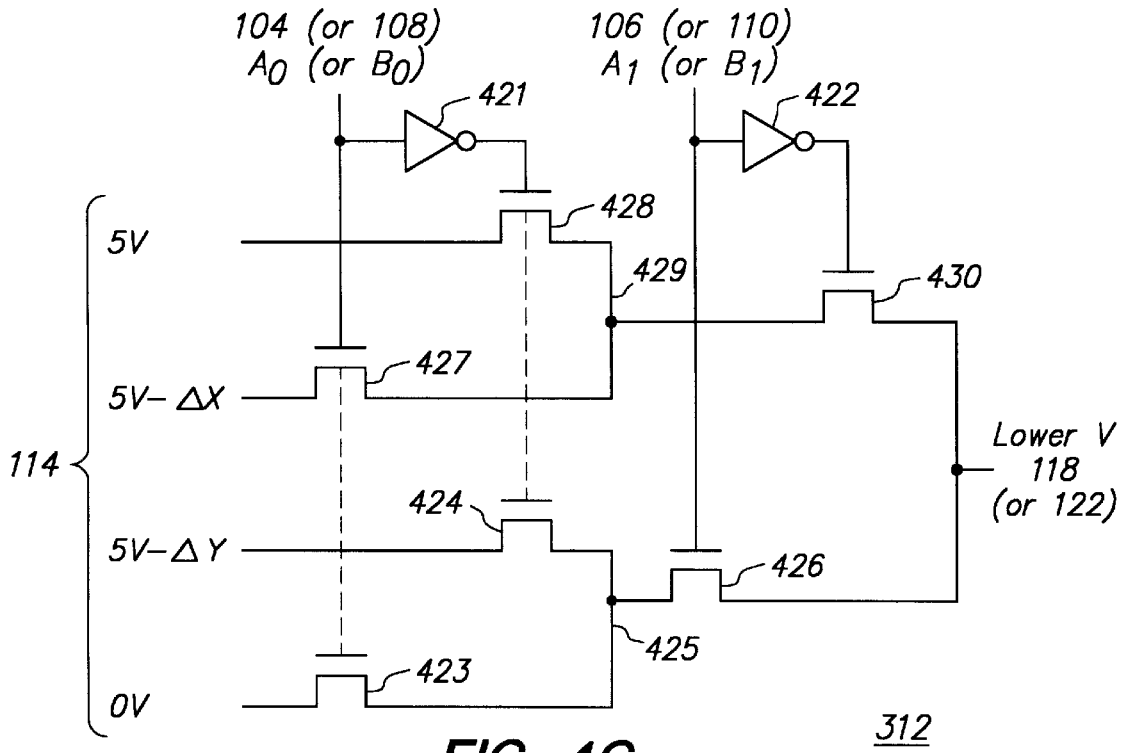
FIG. 4C is a schematic diagram of a first and preferred NMOS-based circuit according to the present invention.

FIG. 4C is a schematic diagram of a first and preferred NMOS-based circuit 312 according to the present invention. The first NMOS-based circuit 312 comprises two inverters 421 and 422 and six enhancement-type NMOS switches 423, 424, 426, 427, 428, and 430.

The low order bit $A_0$ for column X (or the low order bit $B_0$ for column X+1) is input along the first digital line 104 (or the third digital line 108) into a first inverter 421 which inverts the low order bit $A_0$ and outputs $A_0$', where prime denotes an inverse or complement of. Similarly, the high order bit $A_1$ for column X (or the high order bit $B_1$ for column X+1) is input along the second digital line 106 (or the fourth digital line 110) into a second inverter 422 which inverts the low order bit $A_1$ and outputs $A_1$'.

Regarding the three enhancement-type NMOS switches 423, 424, and 426 in the bottom half of FIG. 4C, the first digital line 104 (or the third digital line 108) is connected to the gate electrode of a first NMOS transistor (or switch) 423. The lowest voltage (0 V) in the lower voltage set 114 is connected to the source of the first NMOS 424 switch. When the low order bit $A_0$ is high (1), then the first NMOS switch 423 is "on," meaning that the first NMOS switch 423 drives its output (the drain voltage) to 0 V.

The output of the first inverter 421 is connected to the gate electrode of a second NMOS transistor (or switch) 424. The second lowest voltage (5 V−ΔY) in the lower voltage set 114 is connected to the source of the second NMOS switch 424. When the low order bit $A_0$ is low (0), then the second NMOS switch 424 is "on," meaning the second NMOS switch 424 drives its output (the drain voltage) to 5 V−ΔY.

The outputs of the first 423 and the second 424 NMOS switches are connected together by a first intermediate line 425. Thus, when the low order bit $A_0$ is high, the first intermediate line 425 is driven by the first NMOS switch 423 to 0 V, and when the low order bit $A_0$ is low, the first intermediate line 425 is driven by the second NMOS switch 424 to 5 V−ΔY.

The second digital line 106 (or the fourth digital line 110) is connected to the gate electrode of a third NMOS transistor (or switch) 426. The first intermediate line 425 is connected to the source of the third NMOS switch 426. When the high order bit $A_1$ is high (1), then the third NMOS switch 426 is "on," meaning that the third NMOS switch 426 drives its output (the drain voltage) to same voltage as that on the first intermediate line 425.

Regarding the three enhancement-type NMOS switches 427, 428, and 430 in the top half of FIG. 4C, the first digital line 104 (or the third digital line 108) is connected to the gate electrode of a fourth NMOS transistor (or switch) 427. The third lowest voltage (5 V−ΔX) in the lower voltage set 114 is connected to the source of the fourth NMOS 427 switch. When the low order bit $A_0$ is high (1), then the fourth NMOS switch 427 is "on," meaning that the fourth NMOS switch 427 drives its output (the drain voltage) to 5 V−ΔX.

The output of the second inverter 422 is connected to the gate electrode of a fifth NMOS transistor (or switch) 428. The highest voltage (5 V) in the lower voltage set 114 is connected to the source of the fifth NMOS switch 428. When the low order bit $A_0$ is low (0), then the fifth NMOS switch 428 is "on," meaning the fifth NMOS switch 428 drives its output (the drain voltage) to 5 V.

The outputs of the fourth 427 and the fifth 428 NMOS switches are connected together by a second intermediate line 429. Thus, when the low order bit $A_0$ is high, the second intermediate line 429 is driven by the fourth NMOS switch 427 to 5 V−ΔX, and when the low order bit $A_0$ is low, the second intermediate line 429 is driven by the fifth NMOS switch 428 to 5 V.

The output of the second inverter 422 is connected to the gate electrode of a sixth NMOS transistor (or switch) 430. The second intermediate line 429 is connected to the source of the sixth NMOS switch 430. When the high order bit $A_1$ is low (0), then the sixth NMOS switch 430 is "on," meaning that the sixth NMOS switch 430 drives its output (the drain voltage) to same voltage as that on the second intermediate line 429.

Regarding the output of the first NMOS-based circuit 312, the output (drain voltage) of both the third NMOS 426 and sixth NMOS 430 switches are connected to the second analog line 118 (or the fourth analog line 122). Thus, when $A_0$=1 and $A_1$=1, then 0 V is driven onto the first analog line 116. When $A_0$=0 and $A_1$=1, then 5 V−ΔY is driven onto the first analog line 116. When $A_0$=1 and $A_1$=0, then 5 V−ΔX is driven onto the first analog line 116. Lastly, when $A_0$=0 and $A_1$=0, then 5 V is driven onto the first analog line 116.

Therefore, like the PMOS circuit 302, the NMOS circuit 312 is able to reduce the number of transistors required to select the lower voltage by almost half compared with a similar circuit of CMOS transistors.

Figure 4D:
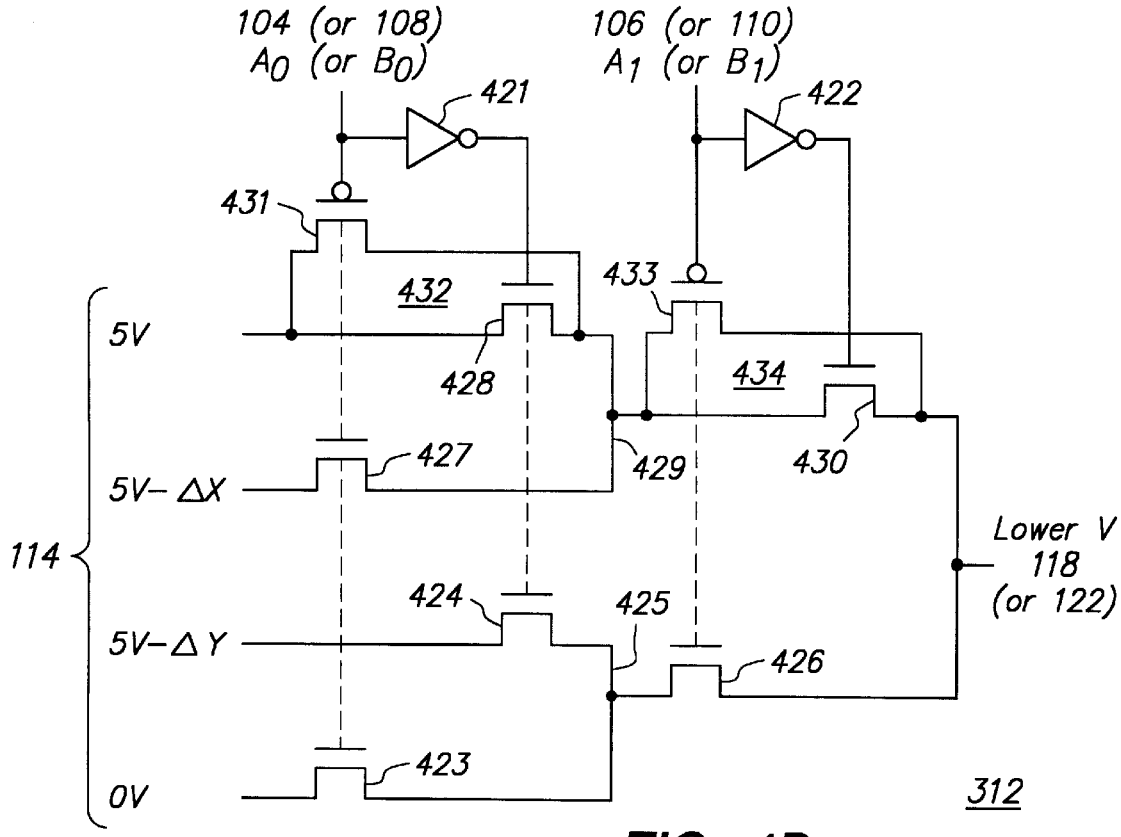
FIG. 4D is a schematic diagram of a second and alternate mostly-NMOS-based circuit according to the present invention.

FIG. 4D is a schematic diagram of a second and alternate NMOS-based circuit 312 according to the present invention. The second NMOS-based circuit 312 is similar to the first NMOS-based circuit 312 in FIG. 4C, except that enhancement-type PMOS transistors are selectively added in parallel to those enhancement-type NMOS transistors that transmit voltages at or near the midpoint voltage.

In this embodiment, the gate of a first enhancement-type PMOS transistor 431 receives $A_0$ from first digital line 104 (or the third digital line 108). The source of the first PMOS transistor 431 receives 5V from the lower voltage set 114. The drain of the first PMOS transistor 431 is connected to the second intermediate line 429.

The first PMOS transistor 431 together with the fifth NMOS transistor 428 form a first CMOS switch 432. When $A_0$=0, the first CMOS switch 432 transmits 5 V and does so better than the fifth NMOS transistor 428 alone.

Similarly, a second enhancement-type PMOS transistor 433 is added in parallel to the sixth NMOS transistor 430 to form a second CMOS switch 434. When $A_0$=0 and $A_1$=0, the second CMOS switch 434 transmits 5 V and does so better than the sixth NMOS transistor 430 alone.

The addition of PMOS transistors in parallel to the first through fourth enhancement-type NMOS transistors 423, 424, 426, and 427 is not typically necessary. This is because an enhancement type NMOS transistor typically conducts sufficiently well the lower voltages transmitted by these lower transistors 423, 424, 426, and 427.

Therefore, with the addition of select PMOS transistors, the NMOS-based circuit still has significantly fewer transistors than a similar circuit of CMOS transistors. The additional PMOS transistors enhance the transmission of voltages near the midpoint.

Figure 4E:
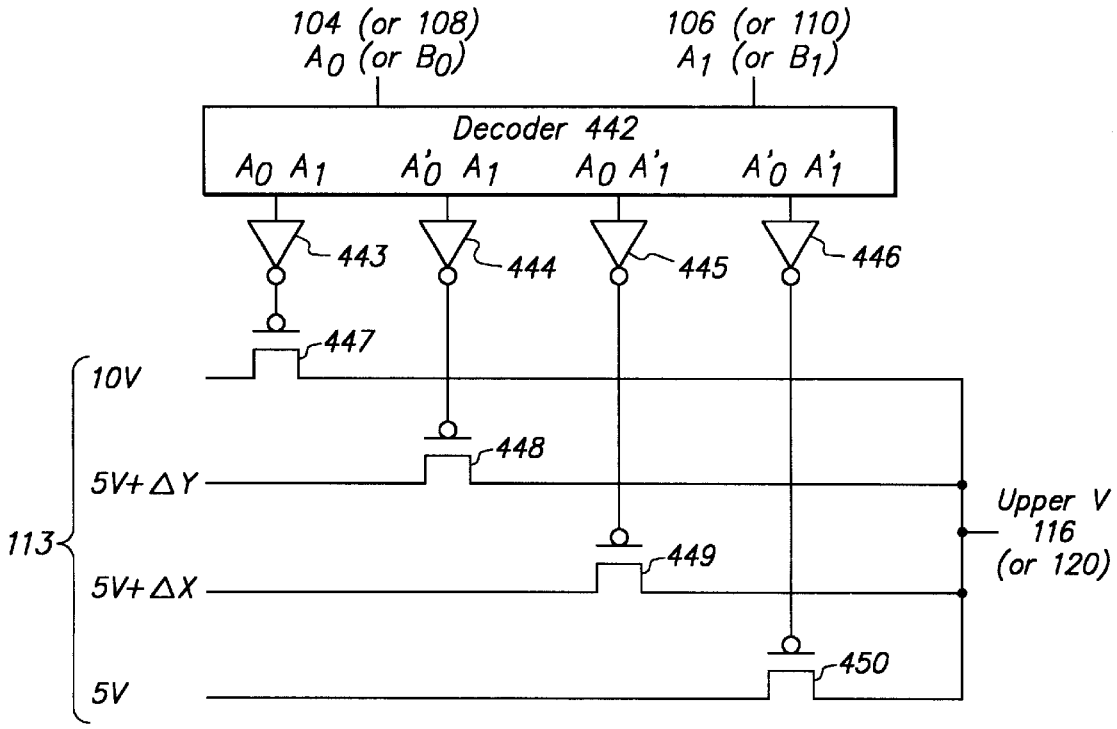
FIG. 4E is a schematic diagram of a third and alternate PMOS-based circuit according to the present invention.

FIG. 4E is a schematic diagram of a third and alternate PMOS-based circuit 302 according to the present invention. The third PMOS-based circuit 302 comprises a decoder circuit 442, four inverters 443–446, and four enhancement-type PMOS switches 447–450.

The decoder circuit 442 receives the low order bit $A_0$ for column X along the first digital line 104 and the high order bit $A_1$ for column X along the second digital line 106 (or the low order bit $B_0$ for column X+1 along the third digital line 108 and the high order bit $B_1$ for column X+1 along the fourth digital line 110). The decoder circuit 442 performs a logical AND operation on the high order bit $A_1$ and the low order bit $A_0$, and it outputs the result $A_0A_1$ on a first decoded line to a first inverter 443 which outputs ($A_0A_1$). The decoder circuit 442 also performs a logical AND operation on the high order bit $A_1$ and the complement of the low order bit $A_0$, and it outputs the result $A_1A_0$ (where prime denotes the complement of) on a second decoded line to a second inverter 444 which outputs ($A_0A_1$). The decoder circuit 442 also performs a logical AND operation on the complement of the high order bit $A_1$ and the low order bit $A_0$, and it outputs the result $A_1A_0$ on a third decoded line to a third inverter 445 which outputs ($A_0A_1$). The decoder circuit 442 also performs a logical AND operation on the complement of the high order bit $A_1$ and the complement of the low order bit $A_0$, and it outputs the result $A_1A_0$ on a fourth decoded line to a fourth inverter 446 which outputs ($A_0A_1$)

Regarding the four enhancement-type PMOS switches 447–450, the output of the first inverter 257 is connected to the gate of a first PMOS transistor 447. The highest voltage (10 V) in the upper voltage set 113 is connected to the source of the first PMOS 447 transistor. When the output of the first inverter 443 is low (i.e., $A_0$=1 AND $A_1$=1), then the first PMOS switch 447 is "on," meaning that the first PMOS switch 447 drives its output (the drain voltage) to 10 V.

The output of the second inverter 444 is connected to the gate of a second PMOS transistor 448. The second highest voltage (5 V+ΔY) in the upper voltage set 113 is connected to the source of the second PMOS 448 transistor. When the output of the second inverter 444 is low (i.e., $A_0$=0 AND $A_1$=1), then the second PMOS switch 448 is "on," meaning that the second PMOS switch 448 drives its output (the drain voltage) to 5 V+ΔY.

The output of the third inverter 445 is connected to the gate of a third PMOS transistor 449. The third highest voltage (5 V+ΔX) in the upper voltage set 113 is connected to the source of the third PMOS 449 transistor. When the output of the third inverter 445 is low (i.e., $A_0$=1 AND $A_1$=0), then the third PMOS switch 449 is "on," meaning that the third PMOS switch 449 drives its output (the drain voltage) to 5 V+ΔX.

The output of the fourth inverter 446 is connected to the gate of a fourth PMOS transistor 450. The lowest voltage (5 V) in the upper voltage set 113 is connected to the source of the fourth PMOS 450 transistor. When the output of the fourth inverter 446 is low (i.e., $A_0$=0 AND $A_1$=0), then the fourth PMOS switch 450 is "on," meaning that the fourth PMOS switch 450 drives its output (the drain voltage) to 5 V.

Regarding the output of the third PMOS-based circuit 302, the outputs (drain voltage) of the first through fourth PMOS switches 447–450 are all connected to the first analog line 116 (or the third analog line 120). Thus, when $A_0$=1 and $A_1$=1, then 10 V is driven onto the first analog line 116. When $A_0$=0 and $A_1$=1, then 5V+ΔY is driven onto the first analog line 116. When $A_0$=1 and $A_1$=0, then 5 V+ΔX is driven onto the first analog line 116. Lastly, when $A_0$=0 and $A_1$=0, then 5 V is driven onto the first analog line 116.

Therefore, this embodiment of the PMOS circuit 302 also reduces the number of transistors used to select the upper voltage compared to a similar circuit of CMOS transistors.

Figure 4F:
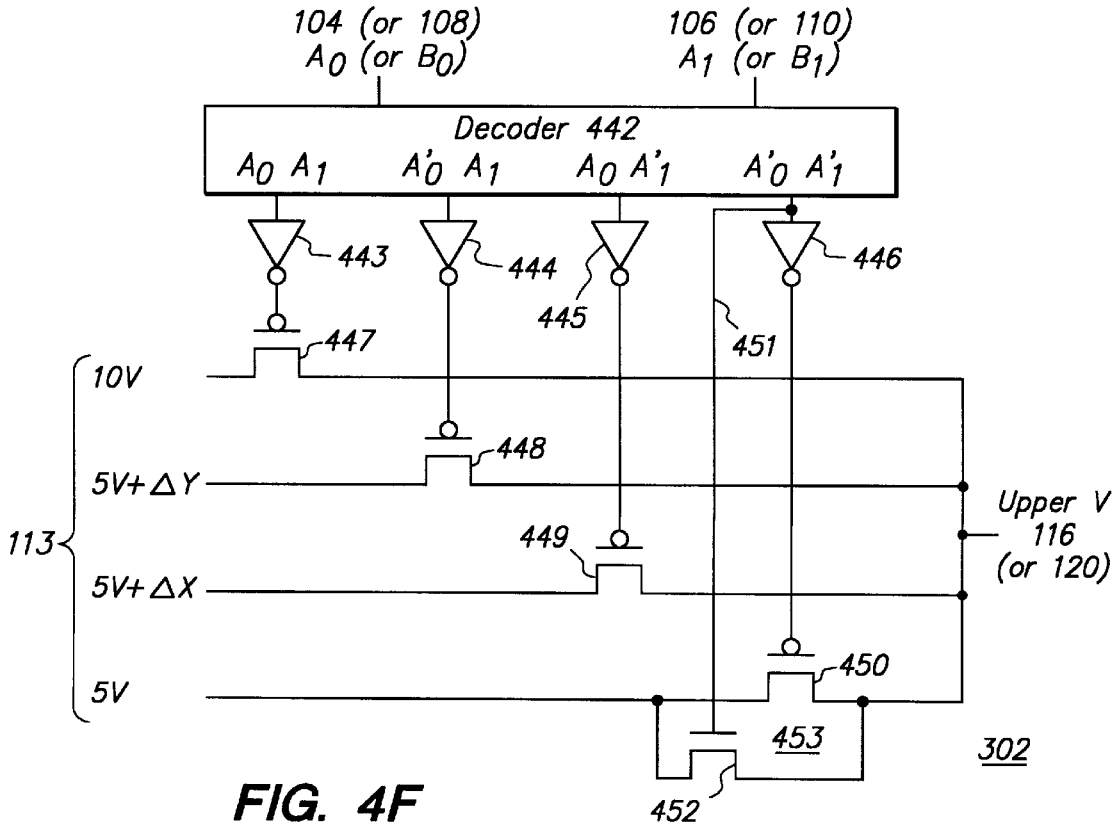
FIG. 4F is a schematic diagram of a fourth and alternate mostly-PMOS-based circuit according to the present invention.

FIG. 4F is a schematic diagram of a fourth and preferred PMOS-based circuit 302 according to the present invention. The fourth PMOS-based circuit 302 is similar to the third PMOS-based circuit 302 in FIG. 4E, except that one or more enhancement-type NMOS transistors are added in parallel to those enhancement-type PMOS transistors that transmit voltages at or near the midpoint voltage.

In this embodiment, a line 451 connects the fourth decoded line to the gate of an enhancement-type NMOS transistor 452. The source of the NMOS transistor 452 receives 5 V from the upper voltage set 113. The drain of the NMOS transistor 452 is connected to the first analog line 116.

The NMOS transistor 452 together with the fourth PMOS transistor 450 form a CMOS switch 453. When $A_0$=0 and $A_1$=0, the CMOS switch 453 transmits 5 V and does so better than the fourth PMOS transistor 450 alone.

The addition of NMOS transistors in parallel to the first through third enhancement-type PMOS transistors 447–449 is not typically necessary. This is because an enhancement-type PMOS transistor typically conducts sufficiently well the higher voltages required to be transmitted by these upper transistors 447–449.

Therefore, this embodiment of the PMOS circuit 302 also reduces the number of transistors required to select the upper voltage, while the additional NMOS transistor 452 enhances the transmission of the voltage near the midpoint voltage.

FIG. 4G is a schematic diagram of a third and alternate NMOS-based circuit 312 according to the present invention. The third NMOS-based circuit 312 comprises a decoder circuit 442 and four enhancement-type NMOS switches 465–468.

The decoder circuit 442 receives the low order bit $A_0$ for column X along the first digital line 104 and the high order bit $A_1$ for column X along the second digital line 106 (or the low order bit $B_0$ for column X+1 along the third digital line 108 and the high order bit $B_1$ for column X+1 along the fourth digital line 110). The decoder circuit 442 performs a logical AND operation on the high order bit $A_1$ and the low order bit $A_0$, and it outputs the result $A_0A_1$ on a first decoded line 461. The decoder circuit 442 also performs a logical AND operation on the high order bit $A_1$ and the complement of the low order bit $A_0$, and it outputs the result $A_1A_0$ (where prime denotes the complement of) on a second decoded 462. The decoder circuit 442 also performs a logical AND operation on the complement of the high order bit $A_1$ and the low order bit $A_0$, and it outputs the result $A_1A_0$ on a third decoded line 463. The decoder circuit 442 also performs a logical AND operation on the complement of the high order bit $A_1$ and the complement of the low order bit $A_0$ and it outputs the result $A_1A_0$ on a fourth decoded line 464.

Regarding the four enhancement-type NMOS switches 465–468, the output of the first decoded line 461 is connected to the gate of a first NMOS transistor 465. The lowest voltage (0 V) in the lower voltage set 114 is connected to the source of the first NMOS transistor 465. When the output of the first decoded line 461 is high (i.e., $A_0$=1 AND $A_1$=1), then the first NMOS switch 465 is "on," meaning that the first NMOS switch 465 drives its output (the drain voltage) to 0 V.

The output of the second decoded line 462 is connected to the gate of a second NMOS transistor 466. The second lowest voltage (5 V−ΔY) in the lower voltage set 114 is connected to the source of the second NMOS transistor 466. When the output of the second decoded line 462 is high (i.e., $A_0$=0 AND $A_1$=1), then the second NMOS switch 466 is "on," meaning that the second NMOS switch 466 drives its output (the drain voltage) to 5 V−ΔY.

The output of the third decoded line 463 is connected to the gate of a third NMOS transistor 467. The third lowest voltage (5 V−ΔX) in the lower voltage set 114 is connected to the source of the third NMOS transistor 467. When the output of the third decoded line 463 is high (i.e., $A_0$=1 AND $A_1$=0), then the third NMOS switch 467 is "on," meaning that the third NMOS switch 467 drives its output (the drain voltage) to 5 V−ΔX.

The output of the fourth decoded line 464 is connected to the gate of a fourth NMOS transistor 468. The highest voltage (5 V) in the lower voltage set 114 is connected to the source of the fourth NMOS transistor 468. When the output of the fourth decoded line 464 is high (i.e., $A_0$=0 AND $A_1$=0), then the fourth NMOS switch 468 is "on," meaning that the fourth NMOS switch 468 drives its output (the drain voltage) to 5 V.

Regarding the output of the third NMOS-based circuit 312, the outputs (drain voltage) of the first through fourth NMOS switches 465–468 are all connected to the second analog line 118 (or the fourth analog line 122). Thus, when $A_0$=1 and $A_1$=1, then 0 V is driven onto the second analog line 118. When $A_0$=0 and $A_1$=1, then 5V−ΔY is driven onto the second analog line 118. When $A_0$=1 and $A_1$=0, then 5 V−ΔX is driven onto the second analog line 118. Lastly, when $A_0$=0 and $A_1$=0, then 5 V is driven onto the second analog line 118.

Therefore, this embodiment of the NMOS circuit 312 also reduces the number of transistors needed to select the lower voltage compared with a similar circuit of CMOS transistors.

FIG. 4H is a schematic diagram of a fourth and alternate NMOS-based circuit 312 according to the present invention. The fourth NMOS-based circuit 312 is similar to the third NMOS-based circuit 312 in FIG. 4G, except that one or more enhancement-type PMOS transistors are added in parallel to those enhancement-type NMOS transistors that transmit voltages at or near the midpoint voltage.

In this embodiment, an inverter 469 connects the fourth decoded line to the gate of an enhancement-type PMOS transistor 470. The source of the PMOS transistor 470 receives 5 V from the lower voltage set 114. The drain of the PMOS transistor 470 is connected to the second analog line 118.

The PMOS transistor 470 together with the fourth NMOS transistor 468 form a CMOS switch 471. When $A_0$=0 and $A_1$=0, the CMOS switch 471 transmits 5 V and does so better than the fourth NMOS transistor 468 alone.

The addition of PMOS transistors in parallel to the first through third enhancement-type NMOS transistors 465–467 is not typically necessary. This is because an enhancement-type NMOS transistor typically conducts sufficiently well the lower voltages required to be transmitted by these lower transistors 465–467.

Therefore, this embodiment of the NMOS circuit 302 also reduces the number of transistors needed to select the lower voltage, while the additional PMOS transistor 470 enhances the transmission of the voltage near the midpoint voltage.

Figure 5:
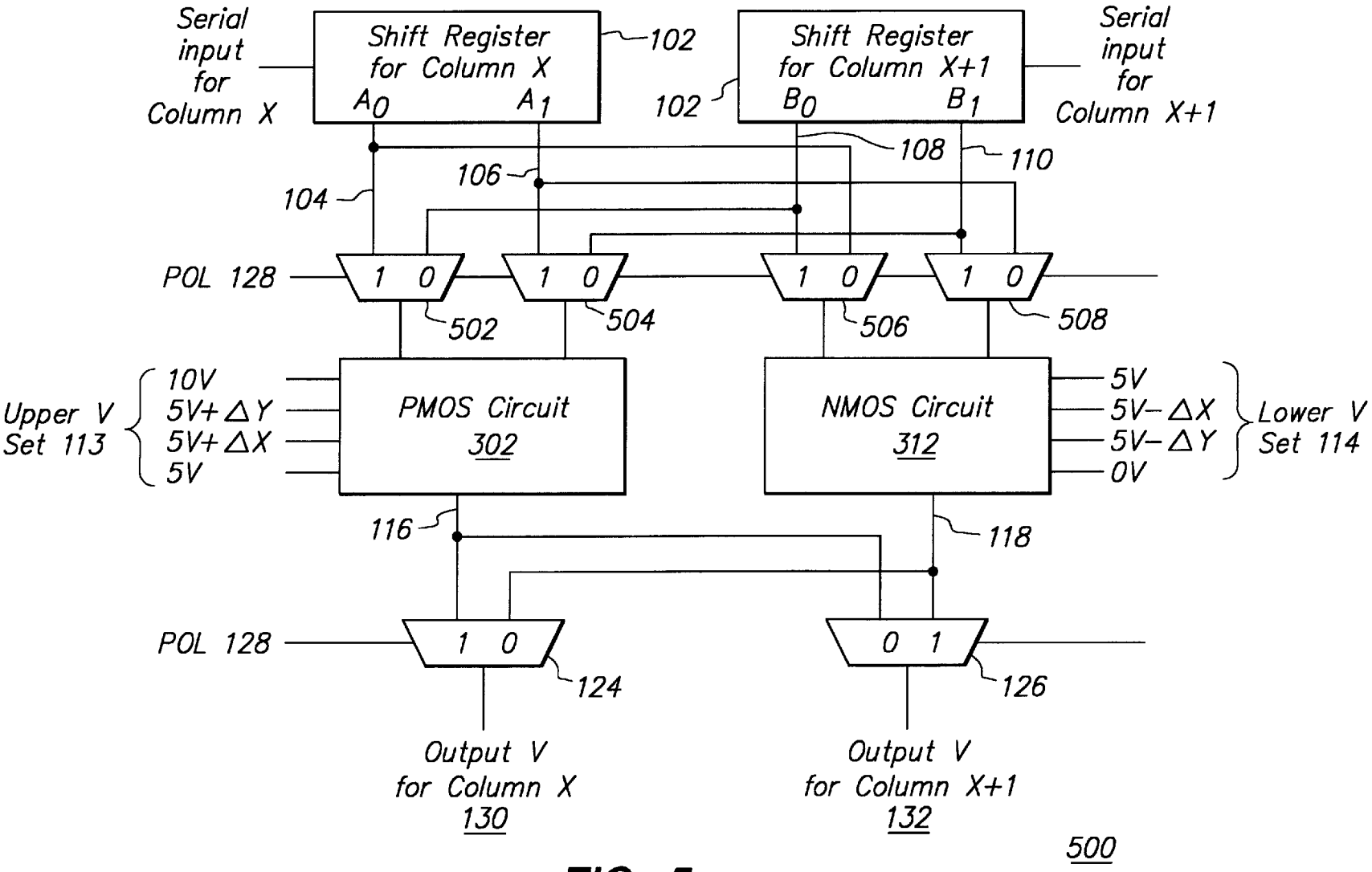
FIG. 5 is a schematic diagram of a third and preferred column driver circuit which multiplexes the input into the PMOS-based and NMOS-based circuits according to the present invention.

FIG. 5 is a schematic diagram of a third and preferred column driver circuit 500 which multiplexes the input into the PMOS-based 302 and NMOS-based 312 circuits according to the present invention. The third column driver circuit 500 is shown for two adjacent columns of a display, column X and column X+1. For purposes of clarity in this description, a two-bit version of the third column driver circuit 500 is shown.

A first digital display data associated with column X is received in serial form by a left shift register 102, and a second digital display data associated with column X+1 is received in serial form by a right shift register 102. The left shift register 102 outputs the first digital display data in parallel form along a first set of lines 104 and 106 to both a first set of multiplexers 502 and 504 and a second set of multiplexers 506 and 508. Similarly, the right shift register 102 outputs the second digital display data associated in parallel form along a second set of lines 108 and 110 to both a first set of multiplexers 502 and 504 and a second set of multiplexers 506 and 508. The first and second sets of multiplexers are controlled by a polarity signal (POL). They are controlled in a manner such that, if the polarity signal is high (1), the first set of multiplexers 502 and 504 selects the first digital display data on the first set of lines, and the second set of multiplexers 506 and 508 selects the second digital display data associated on the second set of lines. Conversely, if the polarity signal is low (0), the first set of multiplexers 502 and 504 selects the second digital display data on the second set of lines, and the second set of multiplexers 506 and 508 selects the first digital display data on the first set of lines.

The first set of multiplexers 502 and 504 outputs the digital display data it selects to a PMOS-based circuit 302. The PMOS-based circuit 302 receives a set of upper analog voltages 113 at or above a midpoint voltage. For the third column circuit 500 shown in FIG. 5, the midpoint voltage is 5 V, and the set of upper analog voltages 113 comprises: 5 V, 5 V+ΔX, 5 V +ΔY, and 10 V. The voltage values for ΔX and ΔY are such that 0 V<ΔX<ΔY<5 V. The PMOS-based circuit 302 selects from the set of upper analog voltages 113 an upper analog voltage which corresponds to the digital display value selected by the first set of multiplexers 502 and 504. The selected upper analog voltage is output by the PMOS-based circuit 302 onto a first analog line 116.

Similarly, the second set of multiplexers 506 and 508 outputs the digital display data it selects to a NMOS-based circuit 312. The NMOS-based circuit 312 receives a set of lower analog voltages 114 at or below a midpoint voltage. For the third column circuit 500 shown in FIG. 5, the midpoint voltage is 5 V, and the set of lower analog voltages 114 comprises: 5 V, 5 V −ΔX, 5 V−ΔY, and 0 V. The voltage values for ΔX and ΔY are such that 0 V<ΔX<ΔY<5 V. The NMOS-based circuit 312 selects from the set of lower analog voltages 114 a lower analog voltage which corresponds to the digital display value selected by the second set of multiplexers 506 and 508. The selected lower analog voltage is output by the NMOS-based circuit 312 onto a second analog line 118.

The first 116 and second 118 analog lines connect to the inputs of a first multiplexer 124 so that the first multiplexer 124 can select either the upper voltage on the first analog line 116 or the lower voltage on the second analog line 118 depending on the value of a polarity signal 128. If the polarity signal 128 is high (1), then the first multiplexer 124 selects the upper voltage on the first analog line 116. If the polarity signal 128 is low (0), then the first multiplexer 124 selects the lower voltage on the second analog line 118.

In addition, the first 116 and second 118 analog lines connect to the inputs of a second multiplexer 126 so that the second multiplexer 126 can select either the upper voltage on the first analog line 116 or the lower voltage on the second analog line 118 depending on the value of the polarity signal 128. If the polarity signal 128 is high (1), then the second multiplexer 126 selects the lower voltage on the second analog line 118. If the polarity signal 128 is low (0), then the second multiplexer 126 selects the upper voltage on the first analog line 116.

Thus, when the polarity signal 128 is high (1), the first multiplexer 124 selects an upper voltage while the second multiplexer 126 selects a lower voltage. Similarly, when the polarity signal 128 is low (0), the first multiplexer 124 selects a lower voltage while the second multiplexer 126 selects an upper voltage. This "inversion" between adjacent pixels in a row is done by design in order to reduce display flicker and crosstalk between columns.

The voltage selected by the first multiplexer 124 is output to the column electrode for column X 130. The voltage selected by the second multiplexer 126 is output to the column electrode for column X+1 132.

For each row selected (activated by application of a selection voltage to the row electrode), the polarity signal 128 applied by the third column driver circuit 500 is either high (1) or low (0). However, between the selection of adjacent rows, the polarity signal 128 is typically switched from high to low, or from low to high. This "inversion" between adjacent rows is done in order to reduce display flicker and crosstalk between rows.

In addition, between the display of adjacent frames (scanning periods), the polarity signal 128 for the first row is typically switched from high to low, or from low to high. This "inversion" between adjacent frames is done in order to reduce display flicker and crosstalk between frames.

An advantage that the third column driver circuit 500 has over the second column driver circuit 300 is that the third column driver circuit 500 takes up less layout area than the second column driver circuit 300. This is because the third column driver circuit 500 uses only one PMOS-based circuit 302 (instead of two) and only one NMOS-based circuit 312 (instead of two) per pair of columns. This is accomplished by using two sets of multiplexers 502, 504, 506, and 508 to enable the PMOS-based 302 and NMOS-based 312 to be shared between two columns. Thus, the design of the third column driver circuit 500 eliminates further unnecessary transistors and has only about one-fourth of the transistors of the first and conventional column driver circuit 600. This advantageous third column driver circuit 500 takes most full advantage of the voltage inversion between neighboring columns in the dot inversion scheme to reduce the number of transistors and hence reduce the size of the circuitry.

From the above discussion, many variations will be apparent to one skilled in the art that would yet be encompassed by the spirit and scope of this invention.

As a first example of a variation, while, for simplicity of explanation, the column driver circuits 100, 300, and 500 in FIGS. 1, 3, and 5 provide only two bits of resolution, the invention encompasses extrapolation of the circuit designs to provide four, six, eight, or more bits of resolution. The extrapolation of the preferred embodiment in FIG. 5 from two bits to four bits is illustrated in FIG. 6.

Figure 6:
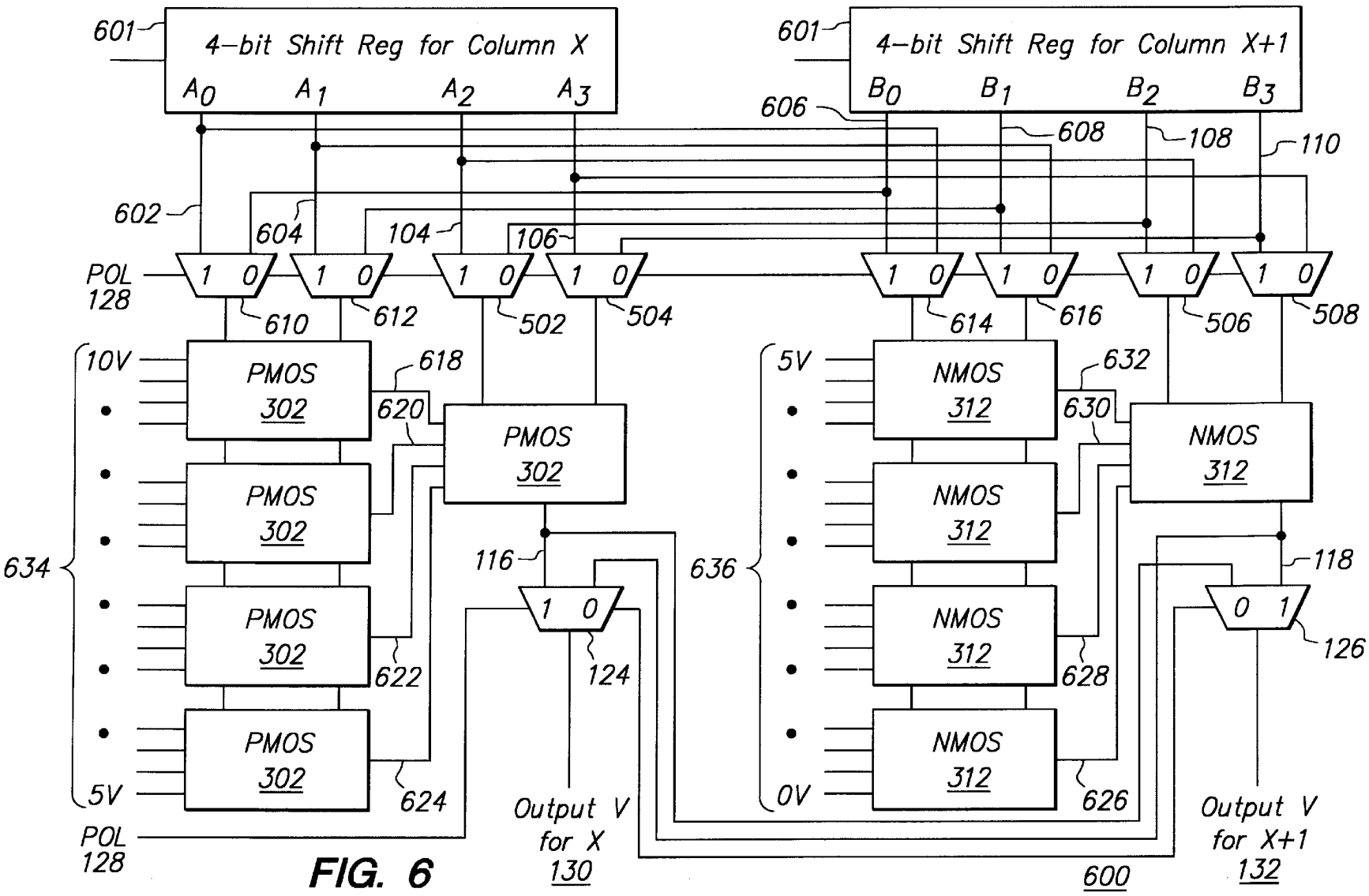
FIG. 6 is a schematic diagram of a fourth and preferred column driver circuit with a cascaded structure to deal with 4-bit display data according to the present invention.

FIG. 6 is a schematic diagram of a fourth and preferred column driver circuit 600 with a cascaded structure to deal with 4-bit display data according to the present invention. The fourth column driver circuit 600 is shown for two adjacent columns of a display, column X and column X+1.

In comparison with the third column driver circuit 500 in FIG. 5, the fourth column driver circuit 600 has two 4-bit shift registers 601 (instead of two 2-bit shift registers 102); four additional multiplexers 610, 612, 614, and 616; four additional PMOS switching circuits 302; four additional NMOS switching circuits 312; and several additional lines 602, 604, 606, 608, 618, 620, 622, 624, 626, 628, 630, and 632 connecting the above circuits together.

In comparison with FIG. 5, the additional circuitry in FIG. 6 is used to accommodate the twelve additional analog voltage levels in the expanded upper voltage set 634 and the twelve additional levels in the expanded lower voltage set 636. Each of the expanded voltage sets 634 and 636 have a total of sixteen levels, as needed for 4-bits of resolution. The expanded voltage sets 634 and 636 are symmetrical about the mid point voltage, similar to the illustration in FIG. 2A.

The four-bit column driver circuit 600 selects one analog voltage level from the sixteen levels in the expanded upper voltage set 634 and one analog voltage level from the sixteen levels in the expanded lower voltage set 636. The selection is made according to the four bits $A_0$, $A_1$, $A_2$, and $A_3$ of display data for column X and the four bits $B_0$, $B_1$, $B_2$, and $B_3$ of display data for column X+1.

The 4-bit shift register 601 for column X outputs four bits of display data $A_0$, $A_1$, $A_2$, and $A_3$ along four lines 104, 106, 602, and 604 to the inputs of two sets of multiplexers. The first set comprises four 2:1 multiplexers 502, 504, 610, and 612, and the second set comprises four 2:1 multiplexers 506, 508, 614, and 616. Similarly, the 4-bit shift register 601 for column X+1 outputs four bits of display data $B_0$, $B_1$, $B_2$, and $B_3$ along four lines 108, 110, 606, and 608 to the inputs of the same two sets of multiplexers. The first set of multiplexers comprises four 2:1 multiplexers 502, 504, 610 and 612, and the second set of multiplexers comprises four 2:1 multiplexers 506, 508, 614, and 616. The multiplexers in both the first and second sets are controlled by a polarity (POL) signal 128. When POL is high (1), then the four multiplexers 502, 504, 610, and 612 in the first set respectively select the four bits $A_2$, $A_3$, $A_0$, and $A_1$ corresponding to column X, and the four multiplexers 506, 508, 614, and 616 in the second set respectively select the four bits $B_2$, $B_3$, $B_0$, and $B_1$ corresponding to column X+1. In contrast, when POL is low (0), then the four multiplexers 502, 504, 610, and 612 in the first set respectively select the four bits $B_2$, $B_3$, $B_0$, and $B_1$ corresponding to column X+1, and the four multiplexers 506, 508, 614, and 616 in the second set respectively select the four bits $A_2$, $A_3$, $A_0$, and $A_1$, corresponding to column X.

The two multiplexers 610 and 612 in the first set of multiplexers that respectively select one of the lowest order bits $A_0$ or $B_0$ and one of the next-lowest order bits $A_1$ or $B_1$ have their outputs connected to the control ports of four PMOS switching circuits 302. A first PMOS circuit 302 selects one analog voltage from the four highest analog voltages in the expanded upper voltage set 634 and outputs its selection onto line 618. A second PMOS circuit 302 selects one analog voltage from the four next-highest analog voltages in the expanded upper voltage set 634 and outputs its selection onto line 620. A third PMOS circuit selects one analog voltage from the four next-next-highest analog voltages in the expanded upper voltage set 634 and outputs its selection onto line 622. Finally, a fourth PMOS circuit 302 selects one analog voltage from the four lowest analog voltages in the expanded upper voltage set 634 and outputs its selection onto line 624. The four lines 618, 620, 622, and 624 connect to the input of yet another (a fifth) PMOS circuit 302.

The fifth PMOS circuit 302 selects one voltage from the four voltages along the four lines 618, 620, 622, and 624. The fifth PMOS circuit 302 makes its selection based on the second-highest order bit $A_2$ or $B_2$ and the highest order bit $A_3$ or $B_3$ which it receives from the two multiplexers 502 and 504, respectively. The fifth PMOS circuit 302 outputs its selection onto a first analog line 116 to two output multiplexers 124 and 126.

Similarly, the two multiplexers 614 and 616 in the second set of multiplexers that respectively select one of the lowest order bits $A_0$ and $B_0$ and one of the next-lowest order bits $A_1$ or $B_1$ have their outputs connected to the control ports of four NMOS switching circuits 312. A first NMOS circuit 312 selects one analog voltage from the four lowest analog voltages in the expanded lower voltage set 636 and outputs its selection onto line 626. A second NMOS circuit 312 selects one analog voltage from the four next-lowest analog voltages in the expanded lower voltage set 636 and outputs its selection onto line 628. A third NMOS circuit 312 selects one analog voltage from the four next-next-lowest analog voltages in the expanded lower voltage set 636 and outputs its selection onto line 630. Finally, a fourth NMOS circuit 312 selects one analog voltage from the four highest analog voltages in the expanded lower voltage set 636 and outputs its selection onto line 632. The four lines 626, 628, 630, and 632 connect to the input of yet another (a fifth) NMOS circuit 312.

The fifth NMOS circuit 312 selects one voltage from the four voltages along the four lines 626, 628, 630, and 632. The fifth NMOS circuit 312 makes its selection based on the second-highest order bit $A_2$ or $B_2$ and the highest order bit $A_3$ or $B_3$ which it receives from the two multiplexers 506 and 508, respectively. The fifth NMOS circuit 312 outputs its selection onto a second analog line 118 to the two output multiplexers 124 and 126.

Four designs for the first through fifth PMOS circuits 302 are shown in FIGS. 4A, 4B, 4E, and 4F (except that the voltage levels of the inputs to the PMOS circuits 302 are as described above in relation to FIG. 6, rather than as indicated in FIGS. 4A, 4B, 4E, and 4F). Similarly, four designs for the first through fifth NMOS circuits 312 are shown in FIGS. 4C, 4D, 4G, and 4H (except again that the voltage levels of the inputs to the NMOS circuits 312 are as described above in relation to FIG. 6, rather than as indicated in FIGS. 4C, 4D, 4G, and 4H).

The two output multiplexers 124 and 126 can select either an upper voltage on the first analog line 116 or a lower voltage on the second analog line 118 depending on the value of the polarity signal 128. If the polarity signal 128 is high (1), then a first output multiplexer 124 selects the upper voltage and a second output multiplexer 126 selects the lower voltage. If the polarity signal 128 is low (0), then the first output multiplexer 124 selects the lower voltage and the second output multiplexer 126 selects the upper voltage. The output of the first output multiplexer 124 goes to the electrode for column X, and the output of the second output multiplexer 126 goes to the electrode for column X+1.

Thus, the design shown in FIG. 6 shows how the design of FIG. 5 can be adapted to 4 bits or more of resolution using cascading, while still using only a fraction of the transistors of a similar circuit of CMOS transistors.

As a second example of a variation, some column drivers are designed to implement only row inversion, and not dot inversion. A prior art implementation of such a column driver 700 is shown in FIG. 7.

C. Prior Art (Line Inversion)

Figure 7:
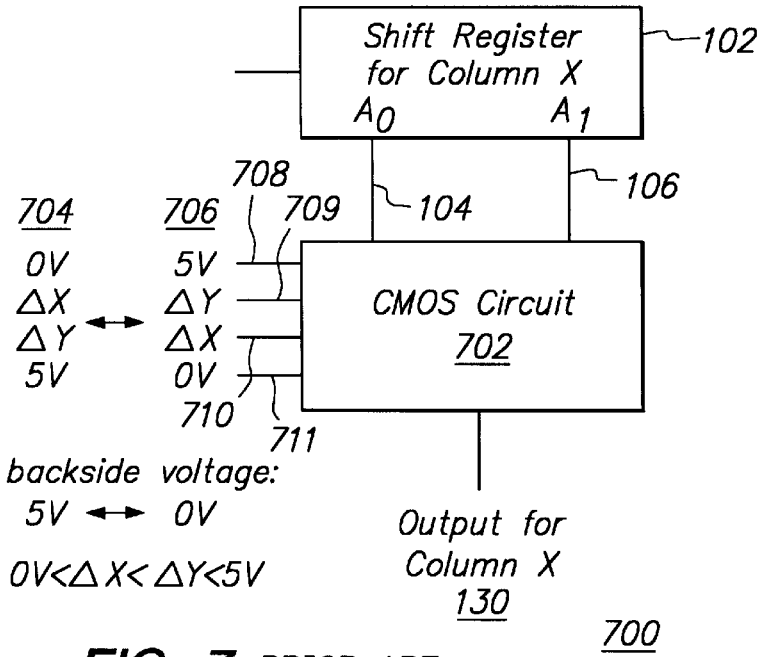
FIG. 7 PRIOR ART
FIG. 7 is a schematic diagram of a fifth and conventional column driver circuit which accommodates row, but not dot, inversion.

FIG. 7 is a schematic diagram of a fifth and conventional column driver circuit 700 which accommodates row, but not dot, inversion. For purposes of clarity in this description, a two-bit version of the fifth column driver circuit 700 is shown.

For each column, a shift register 102 receives serial digital display data and outputs the data in parallel form to a conventional CMOS-based circuit 702. In addition, a group of four ($2^n$, where n=number of bits per digital display value) analog reference voltages is received by the CMOS-based circuit 702.

In the embodiment shown in FIG. 7, the analog reference voltages range from 0 volts to 5 volts, but their arrangement on the four wires may be "switched." In a first arrangement 704, a first line 708 carries 0 volts, a second line 709 carries a voltage of ΔX, a third line 710 carries a voltage of ΔY, and a fourth line 711 carries a voltage of 5 volts, where 0 volts<ΔX<ΔY<5 volts. The voltages on the four lines 708–711 may be switched from the first arrangement 704 to a second arrangement 706 to cause inversion. In the second arrangement 706, the first line 708 carries 5 volts, the second line 709 carries a voltage of ΔY, the third line 710 carries a voltage of ΔX, and the fourth line 711 carries 0 volts. Furthermore, in the first arrangement 704, the voltage of the backside electrode of the LCD display panel is 5 volts, while in the second arrangement 706, the voltage of the backside electrode is 0 volts. Thus, in the first arrangement 704, the voltage on the first line 708 relative to the backside voltage is negative five (−5) volts, while in the second arrangement 706, the voltage on the first line 708 relative to the backside voltage is positive five (+5) volts. Meanwhile, the voltage on the fourth line 711 relative to the backside voltage remains at zero (0) volts. Thus, in the first arrangement 704, the voltages along the four lines 708–711 span the left half of the curve in FIG. 2A, while in the second arrangement 706, the voltages along the four lines 708–711 span the right half of the curve in FIG. 2A.

The conventional CMOS-based circuit 702 selects one of the voltages along the four lines 708–711 and outputs its selection along an output line 130 to the electrode for column X. The conventional CMOS circuit 702 is described in more detail below in relation to FIG. 8.

Figure 8:
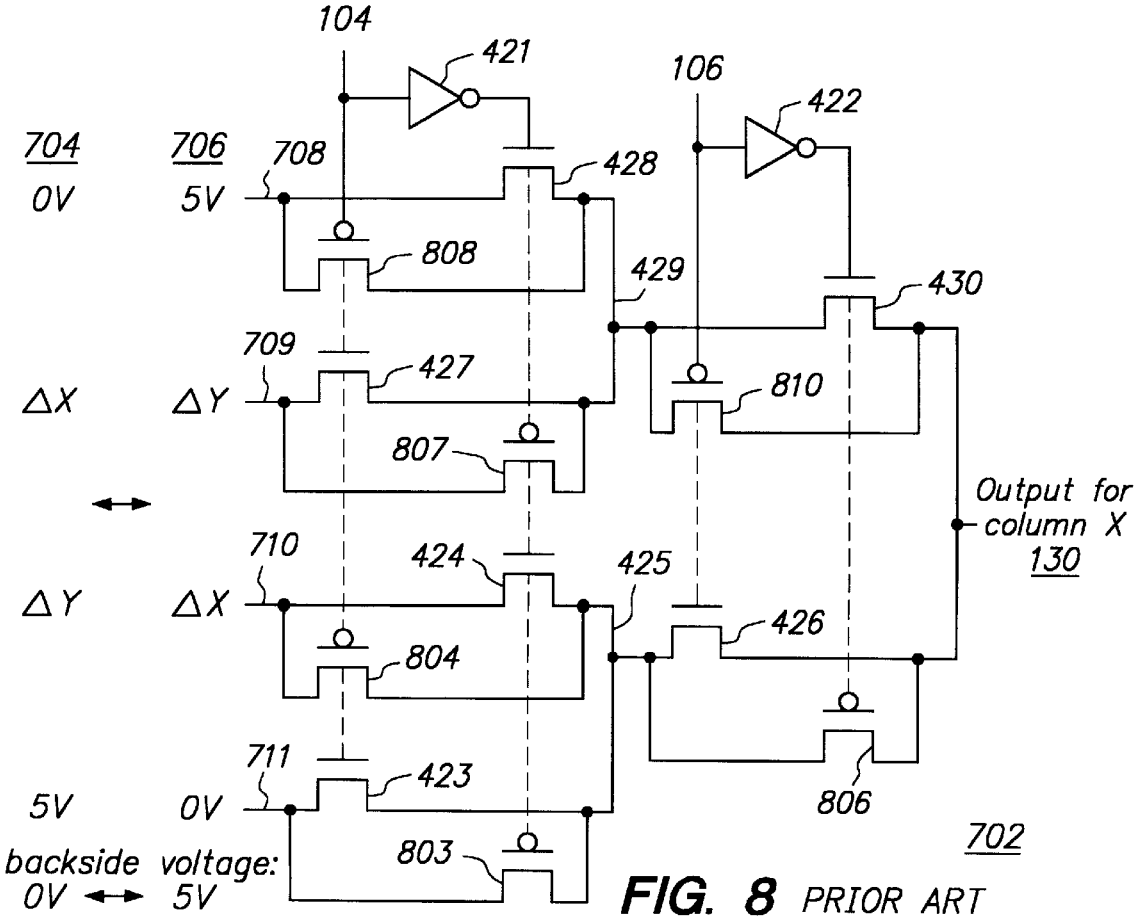
FIG. 8 PRIOR ART
FIG. 8 is a schematic diagram of a conventional CMOS-based circuit for use in the fifth and conventional column driver circuit.

FIG. 8 is a schematic diagram of a conventional CMOS-based circuit 702 for use in the fifth and conventional column driver circuit 700. The conventional CMOS-based circuit 702 is similar to the first NMOS-based circuit in FIG. 4C, except that six PMOS transistors 803, 804, 806, 807, 808, and 810 are added in parallel to the six NMOS transistors 423, 424, 426, 427, 428, and 430, respectively. Furthermore, the analog reference levels input into the conventional CMOS-based circuit 702 include the two arrangements 704 and 706 described above in relation to FIG. 7. Finally, the output of the conventional CMOS-based circuit 702 goes to the electrode for column X 130 as indicated in FIG. 7.

D. Present Invention (Line Inversion)

Figure 9:
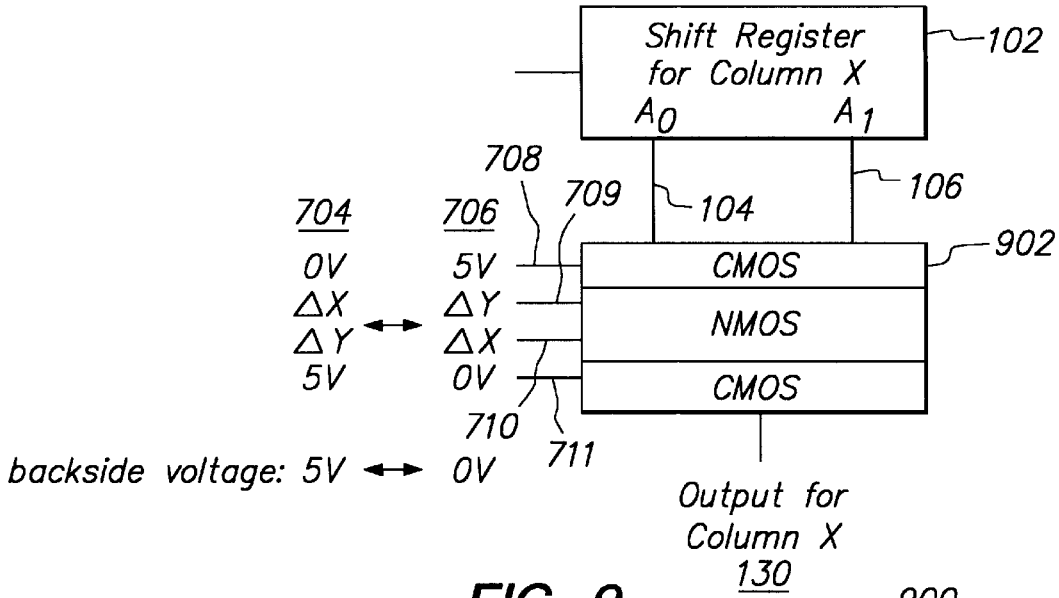
FIG. 9 is a schematic diagram of a sixth and alternate column driver circuit which accommodates row, but not dot, inversion according to the present invention.

FIG. 9 is a schematic diagram of a sixth and alternate column driver circuit 900 which accommodates row, but not dot, inversion according to the present invention. For purposes of clarity, a two-bit version of the sixth column driver circuit 900 is shown.

The sixth column driver circuit 900 is similar to the fifth column driver circuit 700 in FIG. 7, except that the conventional CMOS-based circuit 702 is replaced by a (NMOS/CMOS) circuit 902 which includes both NMOS and CMOS switches. The NMOS/CMOS circuit 902 takes up less layout area than the conventional CMOS-based circuit 702 without sacrificing significant performance. The NMOS/CMOS circuit 902 is described in detail below in relation to FIG. 10.

Figure 10:
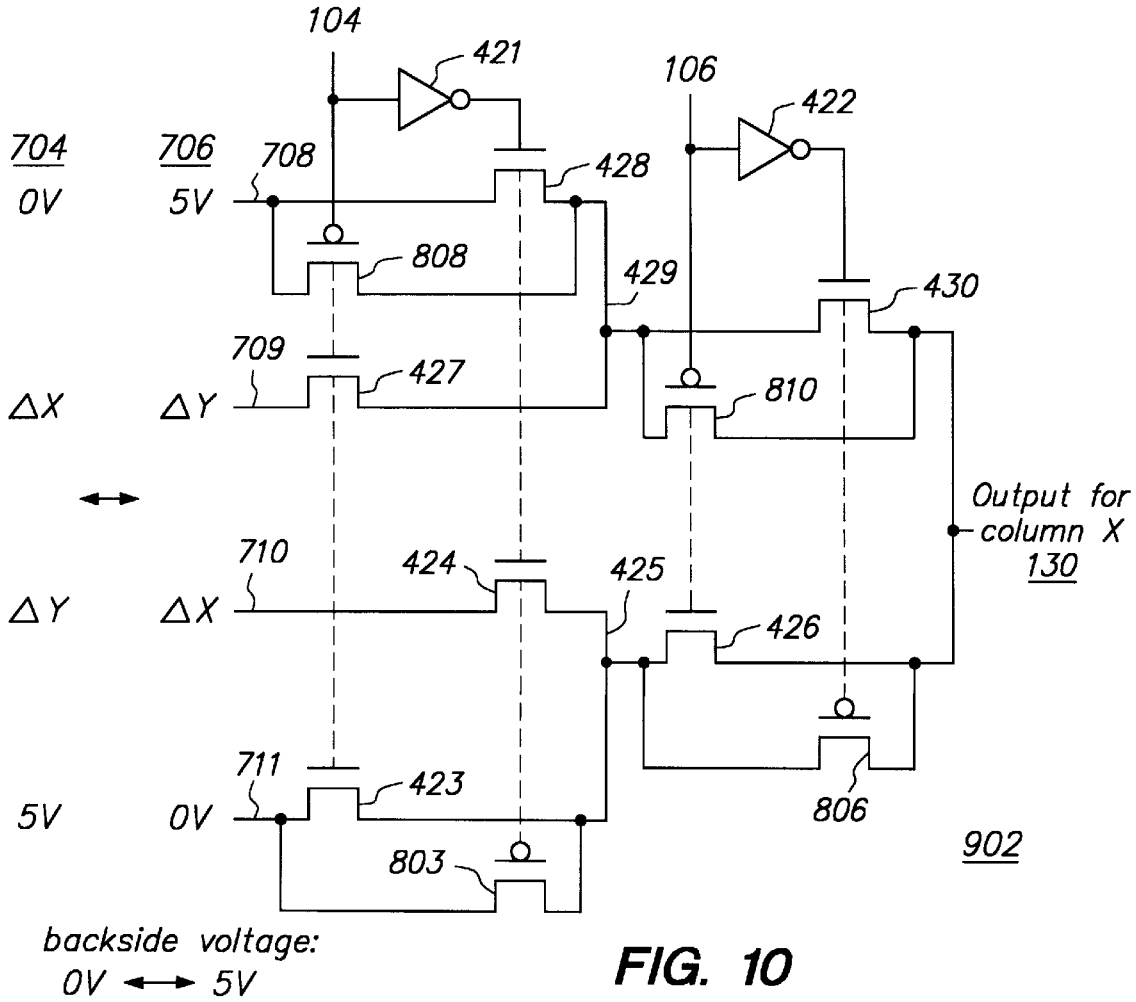
FIG. 10 is a schematic diagram of the NMOS/CMOS circuit for use in the sixth and alternate column driver circuit according to the present invention.

FIG. 10 is a schematic diagram of the NMOS/CMOS circuit 902 for use in the sixth and alternate column driver circuit 900 according to the present invention. The NMOS/CMOS circuit 902 is similar to the conventional CMOS-based circuit 702, except that the two NMOS transistors 424 and 427 which receive voltages of ΔX and ΔY along the two lines 709 and 710 do not have PMOS transistors 804 and 807 in parallel. This difference saves layout space without any significant reduction in performance.

An alternative embodiment of the NMOS/CMOS circuit 902 in FIG. 10 would be a PMOS/CMOS circuit in which the two NMOS transistors 424 and 427 which receive voltages of ΔX and ΔY along the two lines 709 and 710 are replaced by PMOS transistors. Such a substitution would be possible because both NMOS and PMOS transistors transmit sufficiently well intermediate voltages ΔX and ΔY (though the NMOS transistors do not transmit 5 volts as well and the PMOS transistors do not transmit 0 volts as well).

The above description is included to describe the operation of the preferred embodiments and is not meant to limit the scope of the invention. The scope of the invention is to be limited only by the following claims.

What is claimed is:

1. An electronic circuit for converting a digital value to an analog voltage, the circuit comprising:

a first subcircuit for receiving a plurality of upper analog display voltages and selecting one of the upper analog display voltages based upon the digital value, the first subcircuit containing a larger number of PMOS transistors than NMOS transistors;

a second subcircuit for receiving a plurality of lower analog display voltages and selecting one of the lower analog display voltages based upon the digital value, the second subcircuit containing a larger number of NMOS transistors than PMOS transistors;

a multiplexer coupled between the first subcircuit and the second subcircuit for selecting either the upper analog display voltage or the lower analog display voltage.

2. A method for driving a column of an active matrix display, the method comprising the steps of:

receiving a digital value and a polarity signal;

using a first set of transistors to select an upper analog voltage from a set of upper analog voltages as a function of the received digital value, wherein the first set of transistors is comprised of more PMOS than NMOS transistors;

using a second set of transistors to select a lower analog voltage from a set of lower analog voltages as a function of the received digital value, wherein the second set of transistors is comprised of more NMOS than PMOS transistors;

driving the column of the active matrix display with the upper analog voltage if the polarity signal is in a first state; and driving the column of the active matrix display with the lower analog voltage if the polarity signal is in a second state.

3. An electronic circuit for driving a column electrode of an active matrix display, the circuit comprising:

a plurality of lines for communicating a digital display value;

a first set of lines for conducting a set of upper analog voltages above a midpoint voltage;

a second set of lines for conducting a set of lower analog voltages below the midpoint voltage;

a first digital-to-analog converter with more PMOS transistors than NMOS transistors for selecting from the first set of lines an upper analog voltage which corresponds to the digital display value; and a second digital-to-analog converter with more NMOS transistors than PMOS transistors for selecting from the second set of lines a lower analog voltage which corresponds to the digital display value.

4. The electronic circuit of claim 3, wherein a shift register outputs the digital display value to the plurality of lines.

5. The electronic circuit of claim 3, wherein the sets of upper and lower analog voltages are approximately symmetrical across a midpoint voltage.

6. The electronic circuit of claim 5, wherein display inversion is achieved by switching between the upper analog voltage which corresponds to the digital display value and the lower analog voltage which corresponds to the digital display value.

7. The electronic circuit of claim 5, further comprising:

a polarity signal with a high state and a low state; and a multiplexer coupled to said polarity signal for receiving the selected upper and lower analog voltages, outputting one of the selected analog voltages if the polarity signal is in the high state, and outputting the other selected analog voltage if the polarity signal is in the low state.

8. The electronic circuit of claim 5, wherein the first digital-to-analog converter further includes a single full CMOS logic switch for conducting an upper analog voltage substantially near the midpoint voltage.

9. The electronic circuit of claim 5, wherein the second digital-to-analog converter further includes a single full CMOS logic switch for conducting a lower analog voltage substantially near the midpoint voltage.

10. The electronic circuit of claim 3, wherein the first digital-to-analog converter further includes a decoder circuit for receiving from the plurality of lines the digital display value and performing logical operations on the digital display value in order to decode the digital display value.

11. The electronic circuit of claim 3, wherein the second digital-to-analog converter further includes a decoder circuit for receiving from the plurality of lines the digital display value and performing logical operations on the digital display value in order to decode the digital display value.

12. An electronic circuit for driving a pair of columns of an active matrix display, the circuit comprising:

a first plurality of lines communicating a first digital display value associated with a first column of the display;

a second plurality of lines communicating a second digital display value associated with a second column of the display;

a polarity signal with a high state and a low state;

a first set of multiplexers coupled to the first and second pluralities of lines, the first set of multiplexers selecting the first digital display value if the polarity signal is in the high state, and selecting the second digital display value if the polarity signal is in the low state; and a second set of multiplexers coupled to the first and second pluralities of lines, the second set of multiplexers selecting the first digital display value if the polarity signal is in the low state, and selecting the second digital display value if the polarity signal is in the high state.

13. The circuit of claim 12, further comprising:

a first set of lines conducting a set of upper analog voltages above a midpoint voltage;

a second set of lines conducting a set of lower analog voltages below the midpoint voltage;

a first digital-to-analog converter having a plurality of PMOS switches for selecting from the first set of lines an upper analog voltage corresponding to said digital display value selected by the first set of multiplexers; and a second digital-to-analog converter having a plurality of NMOS switches for selecting from the second set of lines a lower analog voltage corresponding to said digital display value selected by the second set of multiplexers.

14. The electronic circuit of claim 13, further comprising:

a first multiplexer coupled to both the first digital-to-analog converter and the second digital-to-analog converter for outputting a drive voltage to one column in the pair of columns, said first multiplexer receiving the selected upper and lower analog voltages and outputting the selected upper analog voltage if the polarity signal is in the high state or the selected lower analog voltage if the polarity signal is in the low state; and a second multiplexer coupled to both the first digital-to-analog converter and the second digital to analog converter for outputting a drive voltage to the other column in the pair of columns, said second multiplexer receiving the selected upper and lower analog voltages and outputting the selected lower analog voltage if the polarity signal is in the high state or the selected upper analog voltage if the polarity signal is in the low state.

15. The electronic circuit of claim 13, wherein the first digital-to-analog converter further includes a single full CMOS logic switch for conducting an upper analog voltage substantially near the midpoint voltage.

16. The electronic circuit of claim 13, wherein the second digital-to-analog converter further includes a single full CMOS logic switch for conducting a lower analog voltage substantially near the midpoint voltage.

17. The electronic circuit of claim 13, wherein the first digital-to-analog converter comprises a decoder circuit for receiving said digital value selected by the first set of multiplexers and performing logical operations on said digital value.

18. The electronic circuit of claim 13, wherein the second digital-to-analog converter comprises a decoder circuit for receiving said digital value selected by the second set of multiplexers and performing logical operations on said digital value.

19. A method for driving a pair of columns of an active matrix display, the method comprising the steps of:

receiving a polarity signal capable of being in either a first state or a second state; and routing a first digital display value associated with a first column in the pair of columns to a first digital-to-analog converter and a second digital display value associated with a second column in the pair of columns to a second digital-to-analog converter when the polarity signal is in the first state, wherein the first digital-to-analog converter is comprised of a plurality of PMOS transistors and the second digital-to-analog converter is comprised of a plurality of NMOS transistors; or routing the first digital display value to the second digital-to-analog converter and the second digital display value to the first digital-to-analog converter when the polarity signal is in the second state, wherein the first digital-to-analog converter includes a plurality of PMOS transistors and the second digital-to-analog converter includes a plurality of NMOS transistors.

20. The method of claim 19, further comprising the steps of:

receiving a first set of analog voltages;

receiving a second set of analog voltages;

selecting from the first set of analog voltages a first analog voltage corresponding to the digital display value routed to the first digital-to-analog converter; and selecting from the second set of analog voltages a second analog voltage corresponding to the digital display value routed to the second digital-to-analog converter.

21. The method of claim 20, wherein the first and second sets of analog voltages are approximately symmetrical across a midpoint voltage.

22. The method of claim 20, further comprising the steps of:

routing the first analog voltage to a first electrode associated with the first column and the second analog voltage to a second electrode associated with the second column when the polarity signal is in the first state, or routing the first analog voltage to the second electrode associated with the second column and the second analog voltage to the first electrode associated with the first column when the polarity signal is in the second state.

23. The method of claim 19, wherein the first column is associated with a first column of display pixels, the second column is associated with a second column of display pixels, and the first and second columns of display pixels are adjacent to each other.

* * * * *